US012225994B2

(12) United States Patent
Veinstein

(10) Patent No.: US 12,225,994 B2
(45) Date of Patent: Feb. 18, 2025

(54) EXPANDABLE AND COLLAPSIBLE SUITCASE

(71) Applicant: Jeffrey Veinstein, Belmont, CA (US)

(72) Inventor: Jeffrey Veinstein, Belmont, CA (US)

( * ) Notice: Subject to any disclaimer, the term of this patent is extended or adjusted under 35 U.S.C. 154(b) by 303 days.

(21) Appl. No.: 17/759,558

(22) PCT Filed: Jan. 28, 2021

(86) PCT No.: PCT/US2021/015431

§ 371 (c)(1),
(2) Date: Jul. 27, 2022

(87) PCT Pub. No.: WO2021/154951

PCT Pub. Date: Aug. 5, 2021

(65) Prior Publication Data

US 2023/0116662 A1 Apr. 13, 2023

Related U.S. Application Data

(60) Provisional application No. 62/966,589, filed on Jan. 28, 2020.

(51) Int. Cl.
*A45C 7/00* (2006.01)
*A45C 5/02* (2006.01)
(Continued)

(52) U.S. Cl.
CPC ..... *A45C 7/0031* (2013.01); *A45C 5/02* (2013.01); *A45C 5/03* (2013.01); *A45C 7/0036* (2013.01);
(Continued)

(58) Field of Classification Search
CPC ..... A45C 7/0031; A45C 5/02; A45C 5/03; A45C 7/0036; A45C 13/262; A45C 5/14; A45C 2005/037
(Continued)

(56) References Cited

U.S. PATENT DOCUMENTS 108,187 A * 10/1870 Rice ..... A45C 5/03 190/22
554,298 A * 2/1896 Palica ..... A45C 7/0031 190/104
(Continued)

FOREIGN PATENT DOCUMENTS

CA 2936342 A1 * 1/2018
CN 101773328 A * 7/2010 ..... A45C 5/14
(Continued)

OTHER PUBLICATIONS

International Search Report and Written Opinion issued in International Application No. PCT/US2021/15431 dated Apr. 12, 2021.

*Primary Examiner* — Don M Anderson
*Assistant Examiner* — Justin Caudill
(74) *Attorney, Agent, or Firm* — MEDLER FERRO WOODHOUSE & MILLS PLLC

(57) ABSTRACT

The present disclosure provides an expandable and collapsible luggage item, such as a suitcase. The luggage item can be easily transitioned between two or three different sizes, allowing for use as an overnight or weekend bag, airplane carry-on, or large suitcase. As described herein, the design of the expandable and collapsible luggage item includes various shell panels that are slidably engaged and positioned adjacent each other to allow for the luggage item to collapse and expand.

20 Claims, 22 Drawing Sheets

(51) Int. Cl.
*A45C 5/03* (2006.01)
*A45C 5/14* (2006.01)
*A45C 13/26* (2006.01)

(52) U.S. Cl.
CPC ..... *A45C 13/262* (2013.01); *A45C 2005/037* (2013.01); *A45C 5/14* (2013.01)

(58) Field of Classification Search
USPC ..... 190/104, 22, 103
See application file for complete search history.

(56) References Cited

U.S. PATENT DOCUMENTS 672,143 A * 4/1901 Boughner ..... A45C 7/0031 190/104
968,633 A * 8/1910 Andrews ..... B65D 21/086 232/14
1,241,210 A * 9/1917 Harvey ..... A45C 7/0031 190/104
3,301,457 A * 1/1967 Millian ..... B65D 21/086 229/101
3,338,388 A * 8/1967 Igoe ..... B65D 21/086 223/66
4,312,431 A * 1/1982 Corey ..... A45C 7/0072 190/104
4,724,976 A * 2/1988 Lee ..... B65D 21/086 220/8
5,038,842 A * 8/1991 Huang ..... A45C 7/0059 190/110
5,082,094 A 1/1992 Nechushtan
5,664,652 A 9/1997 Shamah
5,819,891 A * 10/1998 Wang ..... A45C 13/262 280/37
5,878,903 A * 3/1999 Ung ..... B65D 90/587 220/666
7,093,700 B2 8/2006 Krulik et al.
7,874,409 B1 1/2011 Lakhal
2004/0232016 A1 11/2004 Dietrich
2006/0185999 A1 8/2006 Keays
2010/0140309 A1* 6/2010 Jenni ..... B62J 9/23 224/463
2013/0009249 A1 4/2013 Moon
2015/0374086 A1* 12/2015 Yun ..... A45C 7/0022 190/18 A
2017/0174393 A1* 6/2017 Casey ..... A63B 55/00
2017/0033275 A1 11/2017 Chiang
2019/0183218 A1 6/2019 Lai

FOREIGN PATENT DOCUMENTS

CN 111904127 A * 11/2020
DE 10127863 A1 4/2002
JP 3137174 U * 11/2007
WO 2014/001847 A1 1/2014
WO WO-2014148663 A1 * 9/2014 ..... A45C 7/0018
WO WO-2020033710 A1 * 2/2020 ..... A45C 13/04

* cited by examiner

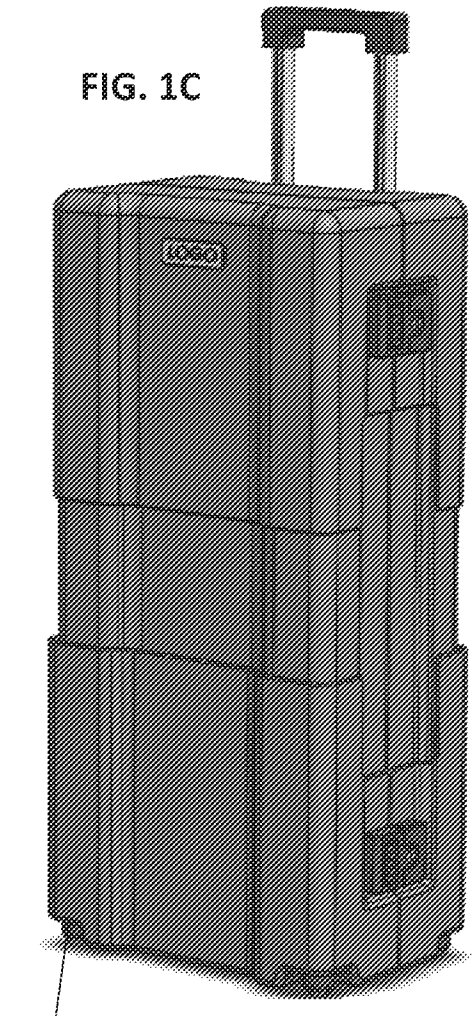
FIG. 1C
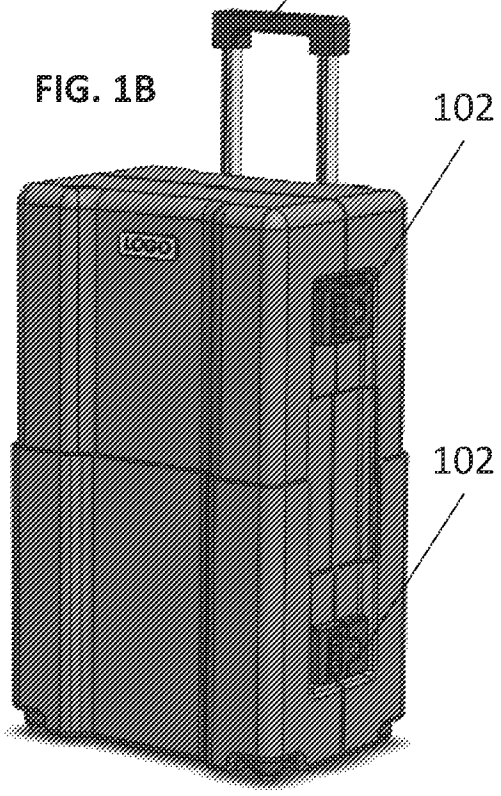
FIG. 1B
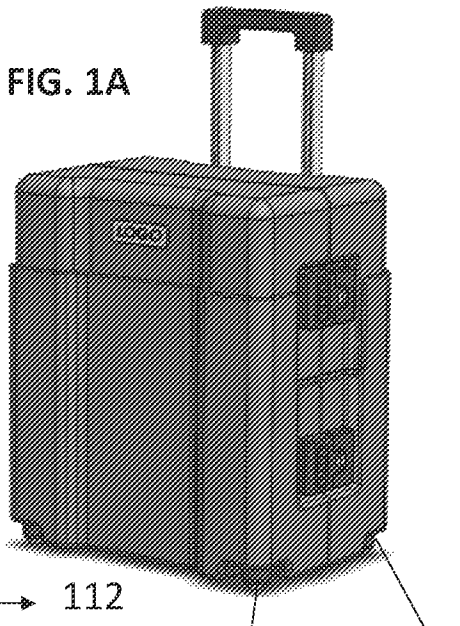
FIG. 1A
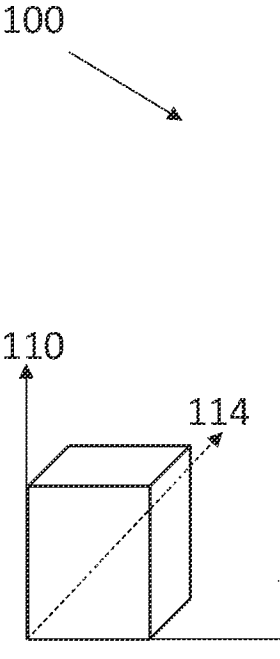

EXPANDABLE AND COLLAPSIBLE SUITCASE

FIELD OF THE INVENTION

The present disclosure provides an expandable and collapsible luggage item, such as a suitcase. The luggage item can be easily transitioned between two or three different sizes, allowing for use as an overnight or weekend bag, airplane carry-on, or large suitcase. As described herein, the design of the expandable and collapsible luggage item includes various shell panels that are slidably engaged and positioned adjacent each other to allow for the luggage item to collapse and expand.

BACKGROUND

Travelers' needs for luggage space can vary significantly depending on the duration of a trip, type of clothing required, climate, etc., and can even change during a trip if items are purchased or left behind at a destination. Expandable and collapsible luggage offers the traveler the ability to purchase a single item that can fulfill many uses, including for example, overnight bag, airplane carry-on, and full-size suitcase.

What is needed is an expandable and collapsible luggage item that can be expanded in a vertical position to at least two different sizes. The present application fulfills this need.

SUMMARY OF THE INVENTION

In some embodiments, the present disclosure provides an expandable and collapsible luggage item, comprising: a body including a back section and a front section, the front section including three slidably-connected shell panels and the back section including three slidably-connected shell panels; an interior of the back section including an expandable frame comprising two telescoping members connected to the interior of the back section; and an interior of the front section including two support brackets, a first support bracket bridging a bottom shell panel and a middle shell panel, and a second support bracket bridging the middle shell panel and a top shell panel, wherein the bottom shell panel is slidably-connected to the middle shell panel and the middle shell panel is slidably-connected to the top shell panel, wherein the expandable frame is configured to expand and collapse the luggage item to a minimum of two vertical positions.

In other embodiments, the present disclosure provides an expandable and collapsible luggage item, comprising: a body including a back section and a front section, the front section including two slidably-connected shell panels and the back section including two slidably-connected shell panels; two telescoping members, a first telescoping member connected to the interior of the front section and a second telescoping member connected to the interior of the back section; and at least one support bracket, the support bracket bridging a bottom shell panel and a top shell panel of the front section or bridging a bottom shell panel and a top shell panel of the back section, wherein the bottom shell panels are slidably-connected to the top shell panels, and wherein the expandable frame is configured to expand and collapse the luggage item to a minimum of three vertical positions.

In additional embodiments, provided herein is an expandable and collapsible suitcase, comprising: a hard-shell body including a back section and a front section, the front section including three slidably-connected shell panels and the back section including three slidably-connected shell panels; an interior of the back section including an expandable frame, the expandable frame having a support base connected to the interior of the back section, and two telescoping members connected to the support base, the telescoping members connected to each other via at least two horizontal supports; and an interior of the front section including two support brackets, a first support bracket bridging a bottom shell panel and a middle shell panel, and a second support bracket bridging the middle and a top shell panel, the first support bracket and the second support bracket each comprising a channel component, a glide component and a spring plunger, wherein the bottom shell panel is slidably-connected to the middle shell panel and the middle shell panel is slidable-connected to the top shell panel, wherein the expandable frame is configured to expand and collapse the item of luggage to a minimum of two vertical positions.

BRIEF DESCRIPTION OF THE DRAWINGS

The foregoing and other features and advantages of the invention will be apparent from the following description of embodiments hereof as illustrated in the accompanying drawings. The accompanying drawings, which are incorporated herein and form a part of the specification, further serve to explain the principles of the invention and to enable a person skilled in the pertinent art to make and use the invention. The drawings may not be to scale.

FIGS. 1A-1C show an expandable and collapsible luggage item in accordance with embodiments hereof.

DETAILED DESCRIPTION OF THE INVENTION

Figure 2A:
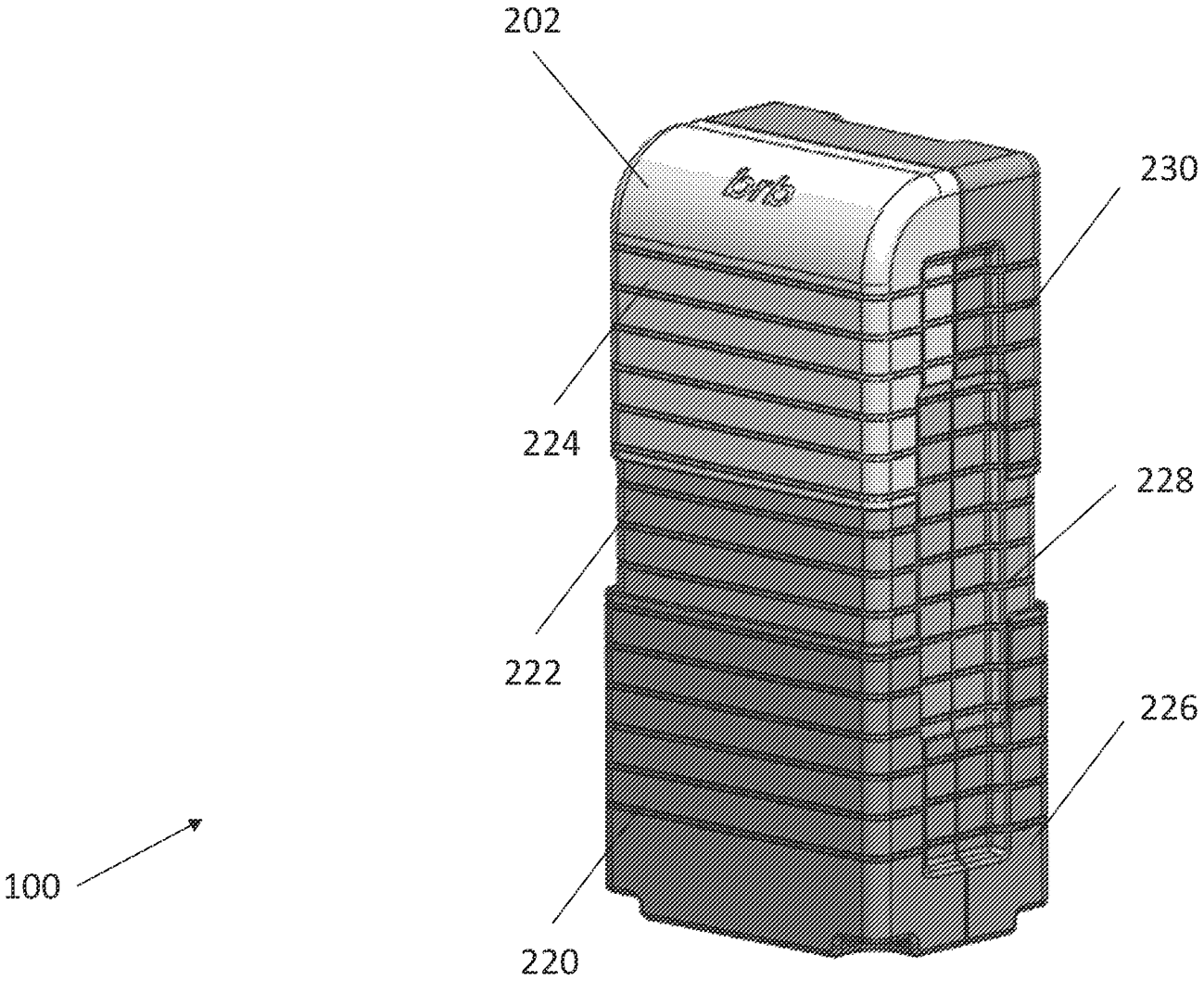
FIG. 2A shows the body of an expandable and collapsible luggage item in accordance with embodiments hereof.

The following detailed description is merely exemplary in nature and is not intended to limit the invention or the application and uses of the invention. Furthermore, there is no intention to be bound by any expressed or implied theory presented in the preceding field of the invention, background, summary or the following detailed description.

As used in this specification, the singular forms "a," "an" and "the" specifically also encompass the plural forms of the terms to which they refer, unless the content clearly dictates otherwise. The term "about" is used herein to mean approximately, in the region of, roughly, or around. When the term "about" is used in conjunction with a numerical range, it modifies that range by extending the boundaries above and below the numerical values set forth. In general, the term "about" is used herein to modify a numerical value above and below the stated value by a variance of 20%. It should be understood that use of the term "about" also includes the specifically recited number of value.

Embodiments of the present invention are directed to an expandable and collapsible luggage item. As used herein a "luggage item" refers to a bag, case or container for holding personal items, suitably for traveling or transporting of such items. Exemplary luggage items that are described herein include, but are not limited to, suitcases, briefcases, duffle bags, computer bags, overnight or weekend bags, hang-up bags, roller bags, trunks, carry-on bags, backpacks, knapsacks, other baggage, etc.

As shown in FIGS. 1A-1C, luggage item 100 is suitably an expandable and collapsible luggage item, in that it can be expanded and/or collapsed between at least two positions. Suitably, the positions are "vertical positions" 110 (a position that makes the luggage item taller), in that luggage item 100 can expand from a minimum vertical position (e.g., FIG. 1A) to a maximum vertical position (e.g., FIG. 1C), with additional intermediate vertical positions (e.g., FIG. 1B) also achievable. Thus, as shown in FIGS. 1A-1C, luggage item 100 can be expanded and collapsed between at least two vertical positions, suitably at least three vertical positions, but can also be expanded and collapsed to four, five, six, etc., vertical positions. In additional embodiments, the luggage item can be expanded in a horizontal position 112 (i.e., perpendicular to the vertical position) or a thickness/depth position 114 as well (i.e., expanding or collapsing the thickness of the luggage item).

In embodiments, a minimum vertical position provides a "weekend bag" or "overnight bag" sized luggage item of about 12-20 inches in height, suitably about 15.5 inches in height (FIG. 1A). In other embodiments, the minimum vertical position of the luggage item can be larger, for example about 14-22 inches in height, suitably about 17.5 inches in height. The height of the luggage item can also be smaller, for example about 5-10 inches in height. An intermediate vertical position suitably provides a "carry-on" sized luggage item of about 20-25 inches in height, suitably about 22 inches in height (FIG. 1B), and an overall size of about 22 inches×14 inches×9 inches. In other embodiments, the intermediate vertical position of the luggage item can be larger, for example about 23-27 inches in height, suitably about 25 inches in height and can encompass various overall sizes. A maximum vertical position suitably provides a "checked bag" sized luggage item of about 25-35 inches in height, suitably about 27-30 inches in height (FIG. 1C), with an overall size of about 27 inches×21 inches×14 inches. In other embodiments, the maximum vertical position of the luggage item can be larger, for example 30-40 inches in height, suitably about 35-40 inches in height and can encompass various overall sizes. Suitably, the thickness of the luggage item 100 described herein is about 9-14 inches, and suitably does not change as the luggage item is expanded or collapsed vertically, though in other embodiments, can also expand or collapse in the thickness dimension. In additional embodiments, the luggage item is suitably an expandable and collapsible luggage item, in that it can be expanded and/or collapsed between more than three vertical positions (e.g., four, five, six, seven, eight, vertical positions, etc.), those vertical positions varying 0.5-6 inches in height between positions, suitably about 3 inches in height.

Luggage item 100 suitably comprises a body 202 (see FIG. 2A) that defines the shape of the luggage item. Body 202 can be a formed or molded body (such as a hard-shell body) or can be supported by a frame (e.g., metal, such as aluminum) inside of the body, over which a fabric, covering, etc., is laid or stretched to form the shape of the body. Shape of body 202 in FIG. 2A (and throughout the Figures), is show for illustrative purposes only and can include any suitable shape of a luggage item (e.g., suitcase, bag, duffle, backpack, briefcase, etc.), and can include "squared" edges giving it a boxy design (e.g., FIGS. 1A-1C) or a more rounded design (e.g., FIGS. 2A and 10).

Exemplary materials for use in body 202 of luggage item 100 include various polymers, such as acrylonitrile butadiene styrene, polycarbonate, aluminum, polypropylene, poly (vinyl chloride), fiberglass, carbon fiber materials, etc., as well as metals, wood, composites of polymers and reinforced polymers, fabrics (e.g., canvas, waxed cotton, leather, Kevlar, etc.), or any combination thereof. In exemplary embodiments body 202 is a hard-shell body, and suitably includes one or more of the polymers described herein, or can be a combination of a polymer and a fabric (e.g., at the connection the front and back sections where a zipper closure can be used), etc.

Figure 3B:
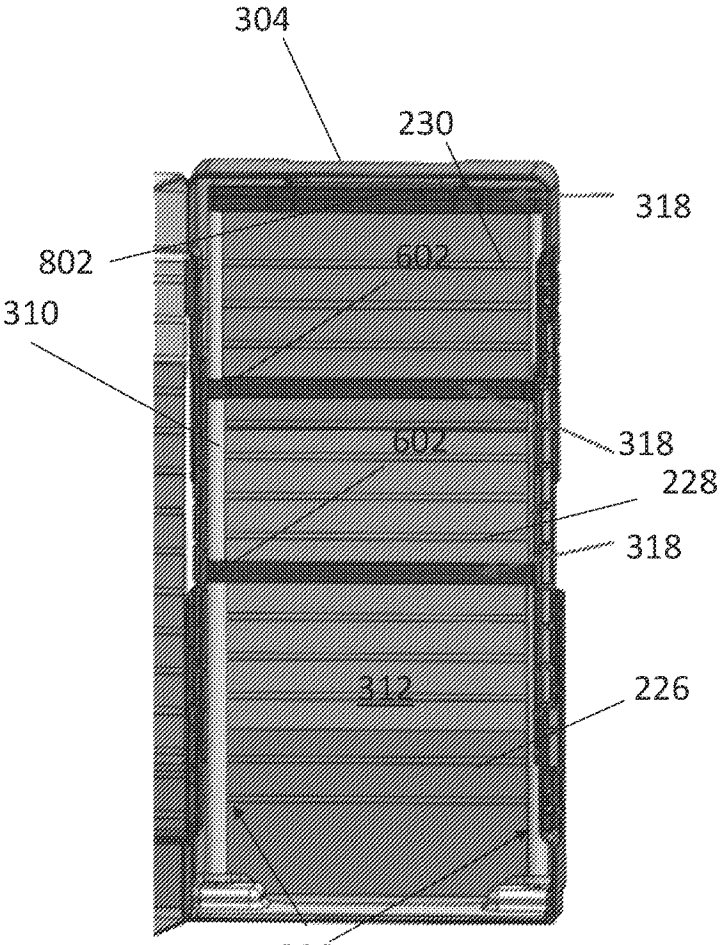
FIGS. 3A-3B show interiors of front and back sections of an expandable and collapsible luggage item in accordance with embodiments hereof.
Figure 3A:
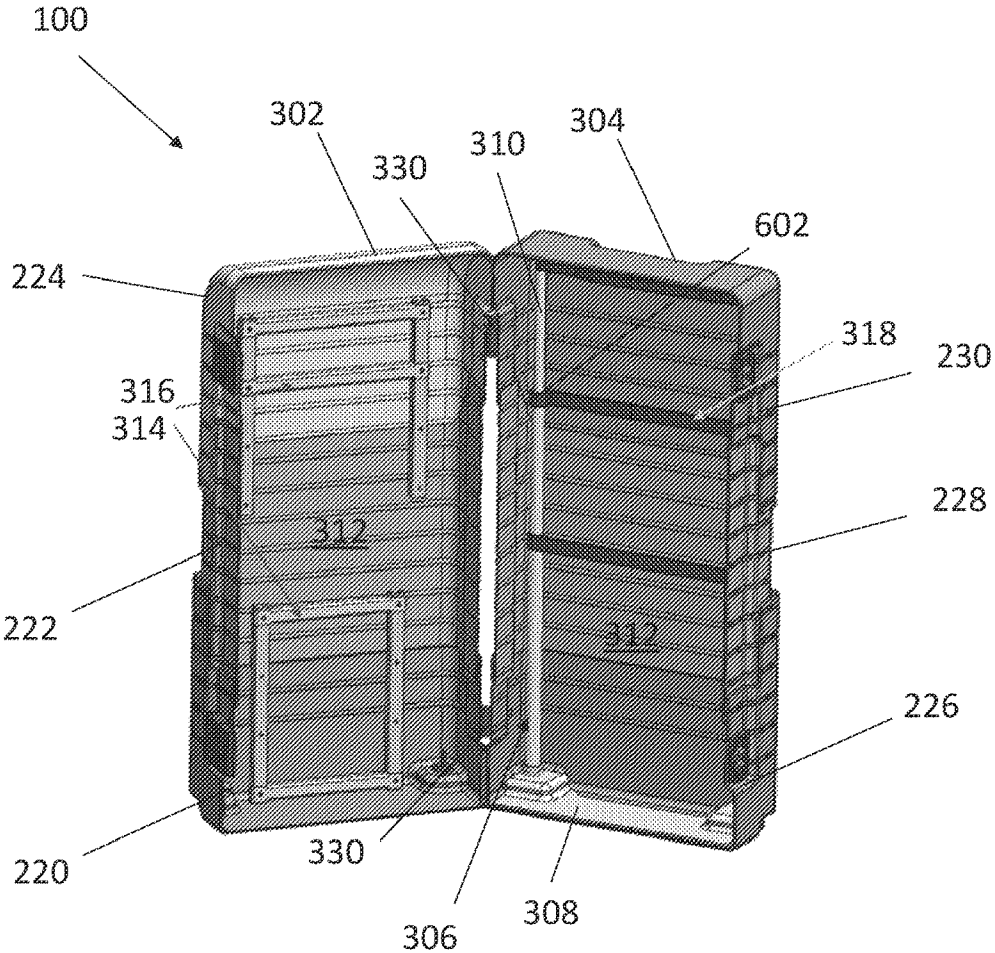

Body 202 suitably includes a back section 304 and a front section 302, as shown in FIG. 3A. Front and back sections as described herein can also be viewed as the top and bottom of a luggage item, if that item was placed on its back (i.e., back section 304 on the floor). Back section 304 of body suitably includes three slidably-connected shell panels.

Front section 302 and back section 304 are suitably connected by one or more, suitably two or more, suitably two, three or four, hinges 330, which can be located near the top and bottom of body 202, and/or in the middle of body 202 to provide additional strength and support (see FIG. 3A).

Figure 2B:
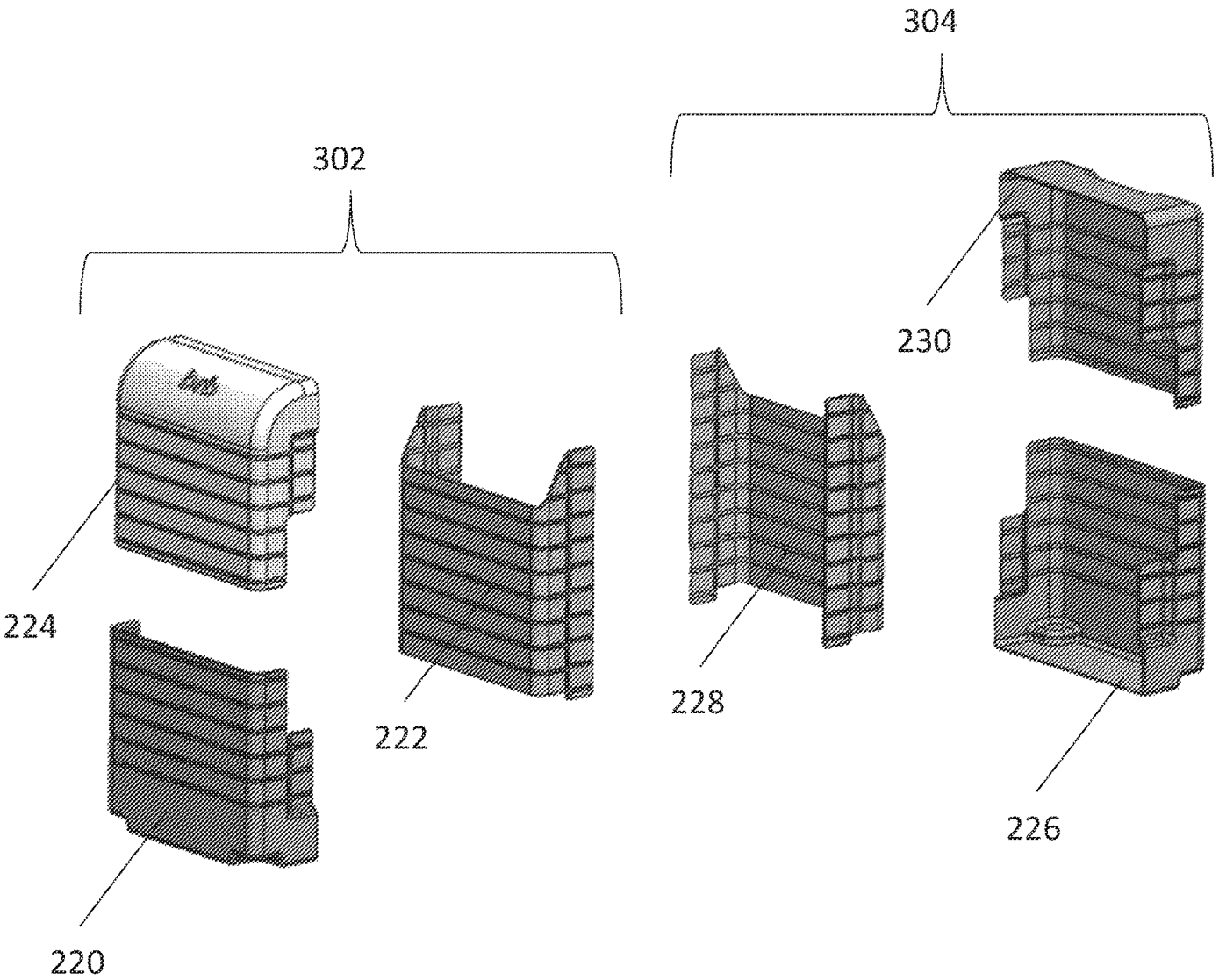
FIG. 2B shows shell panels of an expandable and collapsible luggage item in accordance with embodiments hereof.

As illustrated in FIG. 2B, back section 304 is suitably made up of a bottom shell panel 226, a middle shell panel 228, and a top shell panel 230. The shapes of shell panels in FIG. 2B are provided for illustrative purposes and "shell panel" should be understood to mean separate, individual panels or elements of back section and front section, though in other embodiments, shell panels can also be formed, for example, from a single, pliable material (including a fabric), but that allows for movement of the shell panels with respect to one another. In embodiments, front and back section of the body can include two shell panels, three shell panels, four shell panel, five shell panels, six shell panels, etc., and suitably, each of the shell panels of the front section are slidably-connected and each of the shell panels of the back section are slidably connected.

FIG. 3A shows an exemplary arrangement of the shell panels of back section 304, where the panels are slidably-connected. As used herein, "slidably-connected" means that the shell panels are adjacent, interconnected and overlapping along one or more sides such that they can move relative to one another in a direction, without separating from each other. Slidably-connected shell panels suitably do not require the use of bolts, screws or other mechanisms to connect to each other, but rather can utilize molded or formed elements of the shells to interconnect and slide against one another. See for example, the configuration shown in FIG. 2A, and the close-up of the bottom shell panel 220 and middle shell panel 222, in FIG. 5.

Figures 4A, 4B, 4C:
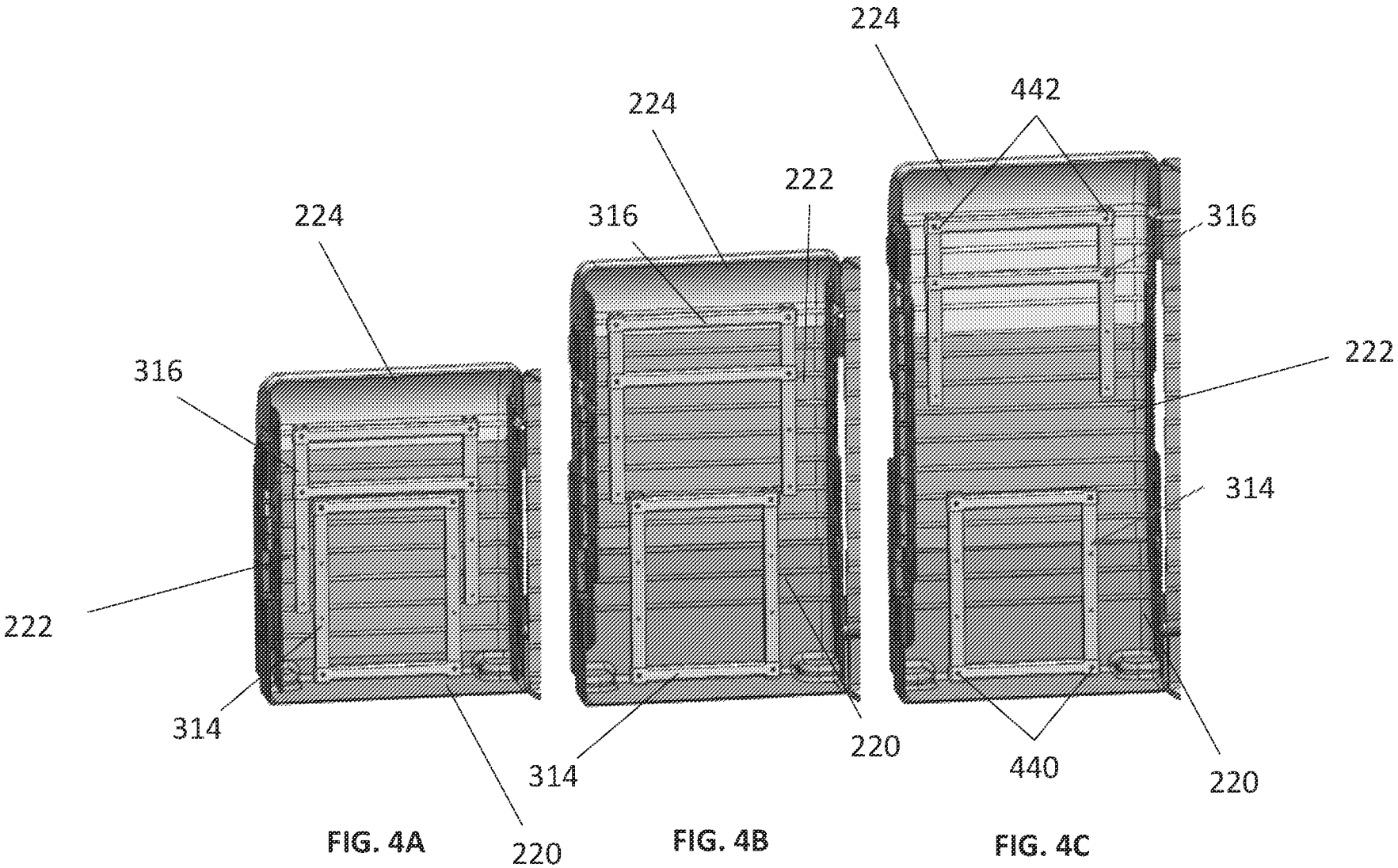
FIGS. 4A-4C show the interior of a front section of an expandable and collapsible luggage item in accordance with embodiments hereof.

For example, as shown in FIG. 2B, front section 302 suitable includes a bottom shell panel 220, a middle shell panel 222 and a top shell panel 224, that are slidably-connected, and form front section 302, as shown in FIG. 3A, and move relative to one another in a sliding motion (i.e., up and down) as shown in FIGS. 4A-4C. Similarly, back section 304 suitable includes a bottom shell panel 226, a middle shell panel 228 and a top shell panel 230, that are slidably-connected, and form back section 302, as shown in FIGS. 3A-3B, and move relative to one another in a sliding motion (i.e., up and down) as shown in FIGS. 6A-6D.

Luggage item 100 expands and collapses via the aid of an expandable frame 306 connected to an interior 312 of back section 304. Expandable frame 306 is configured to expand and collapse luggage item 100 to a minimum of two vertical positions. In suitable embodiments, expandable frame 306 comprises two telescoping members 310. As shown in FIGS. 3A and 3B, telescoping members 310 are suitably cylindrical or pole-shaped members (other shapes or cross-sections, such as square, rectangular, etc., can also be used) that can expand and collapse upon itself, and in embodiments, are hollow members. For example, expandable frame 306 can include telescoping members 310 that are concentric poles or pillars situated within one another that allow for the telescoping members to slide within each other, thereby reaching a minimum height (the height when each of the telescoping members is fully collapsed) to a maximum height (the height when each of the telescoping members is fully extended or expanded). Expandable frame 306 suitably includes two telescoping members 310, but can also include a single telescoping member or can include 3 or 4 or more telescoping members.

Expandable frame 306 can be directly connected to interior 312 of back section 304 (for example, by being molded into or otherwise connected to back section 304), or expandable frame 306 can be connected to or include a support base 308, which in turn is connected directly to interior 312 of back section 304 (suitably to the bottom shell panel 226). Support base suitably is a flat metal or plastic section that adds strength to the expandable frame 306, and expandable frame 306 itself suitably is composed of metal or plastic or a combination of these materials.

Figure 3E:
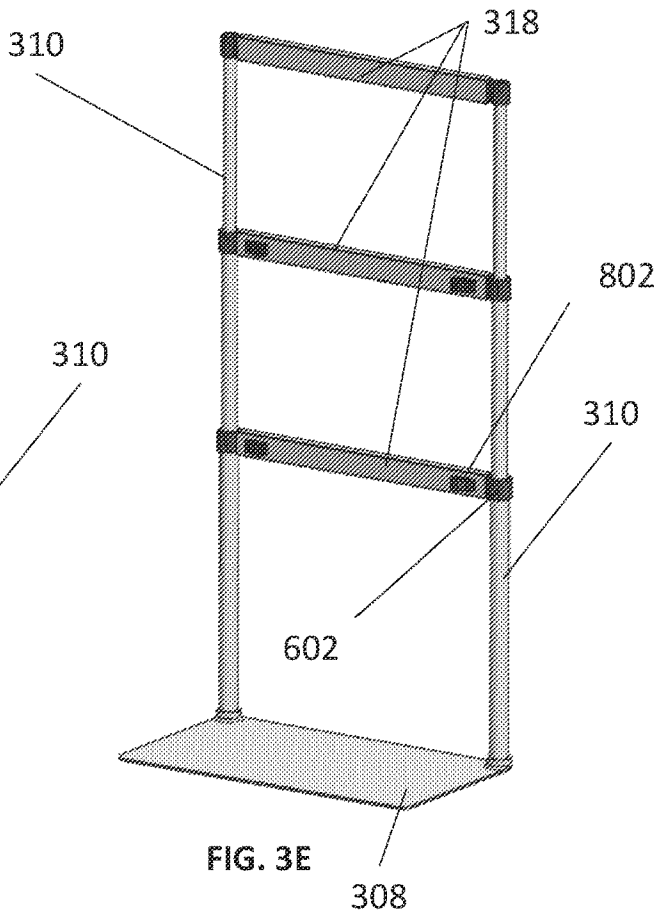
FIGS. 3C-3E show views of an expandable frame for use in an expandable and collapsible luggage item in accordance with embodiments hereof.
Figure 3D:
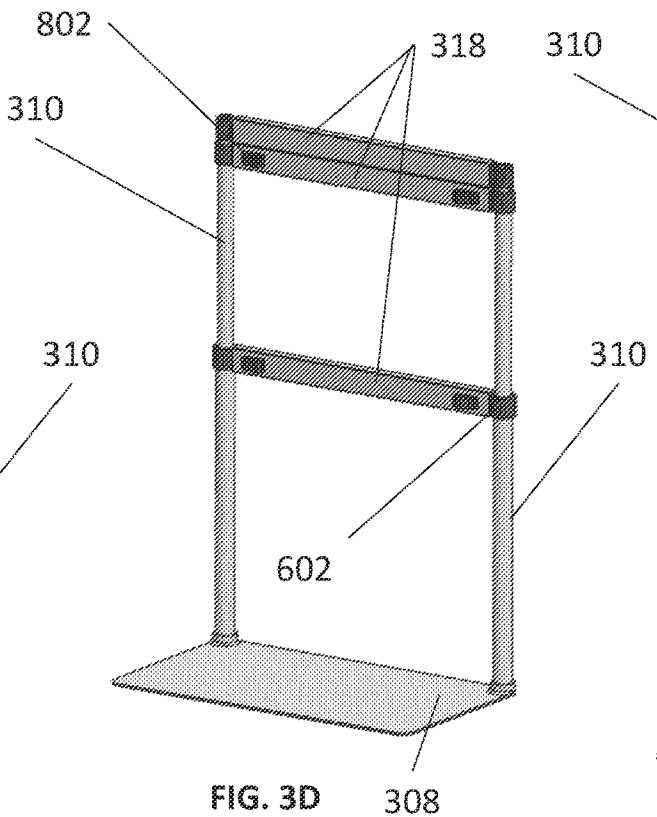
Figure 3C:
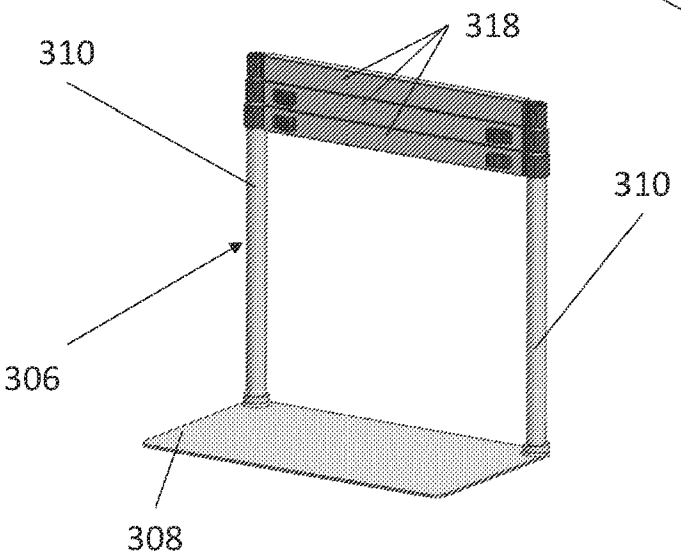

FIGS. 3C-3E show three exemplary positions of expandable frame 306, with the telescoping members 310 at a minimum height (FIG. 3C; about 12-15 inches, suitably about 14 inches), a maximum height (FIG. 3E; about 25-30 inches, suitably about 27 inches), and an intermediate height (FIG. 3D; about 20-24 inches, suitably about 22 inches). As illustrated in FIG. 3E, in embodiments, three different, concentrically sized tubes, bars or pillars (i.e., small, medium and large diameters or cross-sections) are used to construct the telescoping members 310, thereby allowing them to collapse and expand by nesting and fitting within each other. The three different tubes are also suitably different lengths to allow for different heights of expansion, though they can also be the same length.

As shown in FIGS. 3A-3E, telescoping members 310 of expandable frame 306 are suitably connected to each other via one or more, suitably at least two (i.e., two or more, including 3 or more, 4 or more, 5 or more, etc.), horizontal supports 318. As shown in FIGS. 3C-3E, in exemplary embodiments, telescoping members 310 are connected by three horizontal supports 318. Horizontal supports are suitably tubes or bars, and can be hollow or solid pieces of metal, plastic, or combinations thereof. As shown in FIGS. 3C-3E, and as a close-up in FIG. 3F, the two telescoping members 310 each include a movable locking mechanism 602 that is configured to lock and release the telescoping members 310 at, at least two vertical positions, or as shown in FIGS. 3C-3E, at least three vertical positions. Movable locking mechanism 602 can be a locking pin, a locking ball, a locking snap, a locking plunger, or other similar feature, that engages with the telescoping member and stops if from moving (collapsing/expanding) and maintains it in its current position and capable of supporting a load and providing strength to the luggage item. When the movable locking mechanism is disengaged, the telescoping member(s) can collapse or expand, allowing the luggage item to be moved to a different size.

Figure 3F:
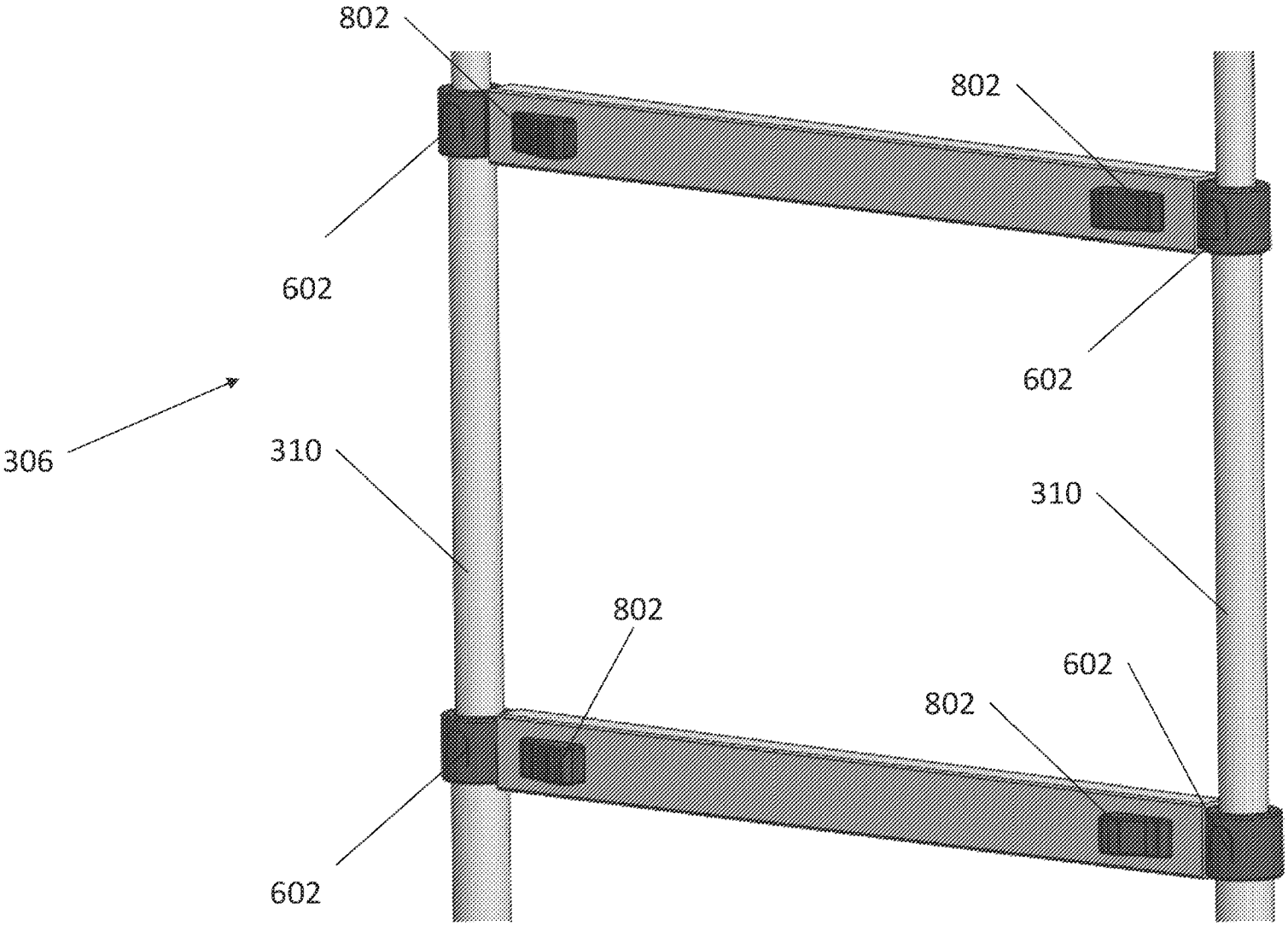
FIG. 3F shows a close-up view of an expandable frame for use in an expandable and collapsible luggage item in accordance with embodiments hereof.
Figure 8B:
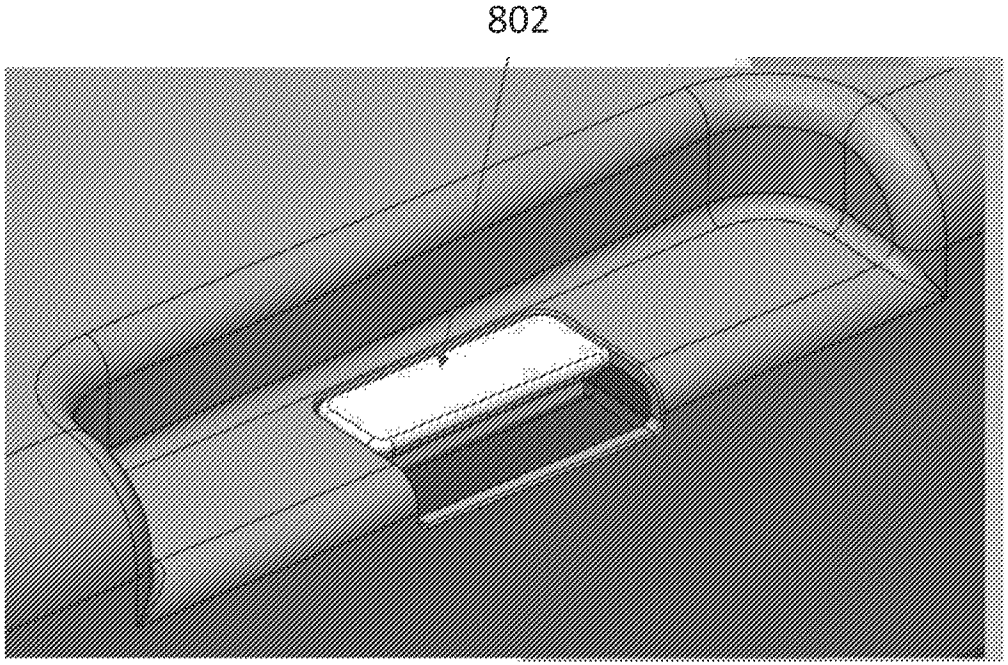
FIGS. 8A-8B show an exemplary release point for use in an expandable and collapsible luggage item in accordance with embodiments hereof.
Figure 8A:
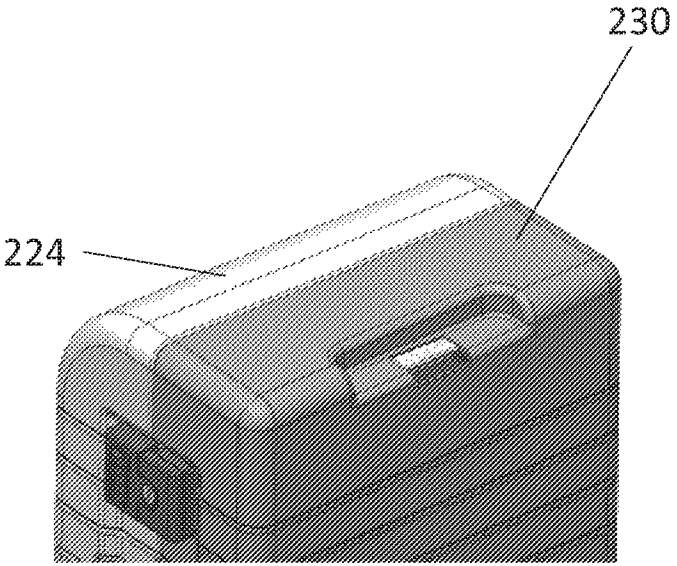

Also as shown in FIGS. 3C-3E and in close-up in FIG. 3F, suitably at least one of horizontal supports 318 includes a release point 802 for movable locking mechanism 602. As shown in FIG. 3F, horizontal supports 318 can each include release point 802, or can include multiple release points 802. Release point(s) 802 can be located at the end of the horizontal supports near the movable locking mechanism 602, or in the middle of the horizontal support, or in any desired configuration. In embodiments, a single release point 802 can be utilized, for example as shown in FIGS. 8A and 8B, and as described herein and can also be outside the luggage item 100. Release point 802 can be a button, a slide, a latch, a push-pin, a rotating device, or any suitable release mechanism that allows for the movable locking mechanism 602 to disengage, and allow the telescoping member(s) to move in an expanding or collapsing manner, as desired.

As shown in FIG. 3A, front section 302 of body 202 of luggage item 100 suitably includes two support brackets 314 and 316, on the interior 312 of the front section. As shown in FIG. 3A, first support bracket 314 suitably bridges (i.e., connects and/or is connected to), bottom shell panel 220 and middle shell panel 222, while a second support bracket 316 bridges middle shell panel 222 and top shell panel 224. As described herein, for front section 302 of body 202, bottom shell panel 220 is slidably-connected to middle shell panel 222, and middle shell panel 222 is slidably-connected to top shell panel 224.

It should be understood that while support brackets 314 and 316 are shown on the interior of front section 302 of body, and expandable frame 306 is shown in the interior of back section 304 of body 202, the location of these interior mechanical elements can be switched to the other (front or back) section of the body 202.

FIGS. 4A-4C show a view of first and second (314 and 316) support brackets during expansion/collapsing of the front section 302. As shown in FIG. 4A, first support bracket 314 can be seen bridging bottom shell panel 220 and middle shell panel 222, while second support bracket 316 bridges middle shell panel 222 and top shell panel 224. As illustrated, first support bracket 314 is suitably a rectangular shape having bottom and top cross pieces, and vertical support pieces. Second support bracket 316 suitably includes two vertical support pieces and two cross-pieces connected at the upper ends of the support bracket.

Figure 5:
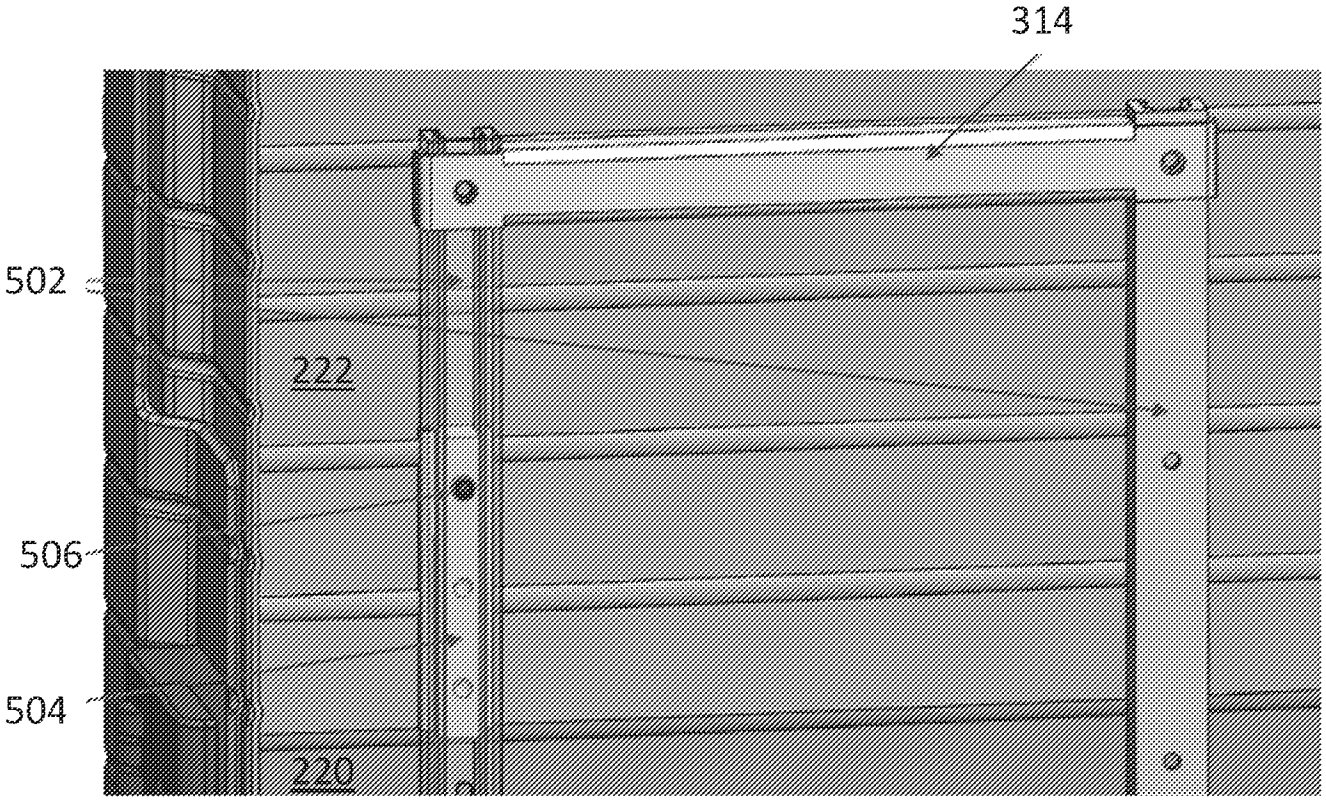
FIG. 5 shows a support bracket in the interior of a front section of an expandable and collapsible luggage item in accordance with embodiments hereof.

As shown in FIG. 5 (close-up of support bracket), suitably the first and second support brackets, 314 and 316, include a channel component 502 within which a glide component 504 sits/rests and can move or slide vertically. The support brackets also include a spring plunger 506 that allow for the glide component to lock and then unlock, prior to vertical, sliding movement. In exemplary embodiments, first support bracket 314 is suitably connected to bottom shell panel 220, for example at anchoring points 440 (i.e., at the corners of first support bracket 314) near the bottom of the luggage item (other locations for anchoring points 440 or other connection scenarios can also be utilized). First support bracket 314 also suitably includes a glide component 504 that is connected to middle shell panel 222 (suitably near the bottom of middle shell panel 222), and that tracks with the middle shell panel 222 (sliding within channel component 502) as it is vertically expanded or contracted, as shown in FIGS. 4B-4C. Suitably, second support bracket 316 is connected to top shell panel 224, for example at two anchoring points 442 (i.e., at the corners of second support bracket 316) near the top of the luggage item (other locations for anchoring points 442 or other connection scenarios can also be utilized). Second support bracket 316 also suitably includes a glide component 504 that is connected to middle shell panel 222 (suitably near the top of middle shell panel 222), and that tracks with the middle shell panel 222 and top shell panel 224 (sliding within channel component 502) as they are vertically expanded or contracted, as shown in FIGS. 4B-4C.

Figure 6D:
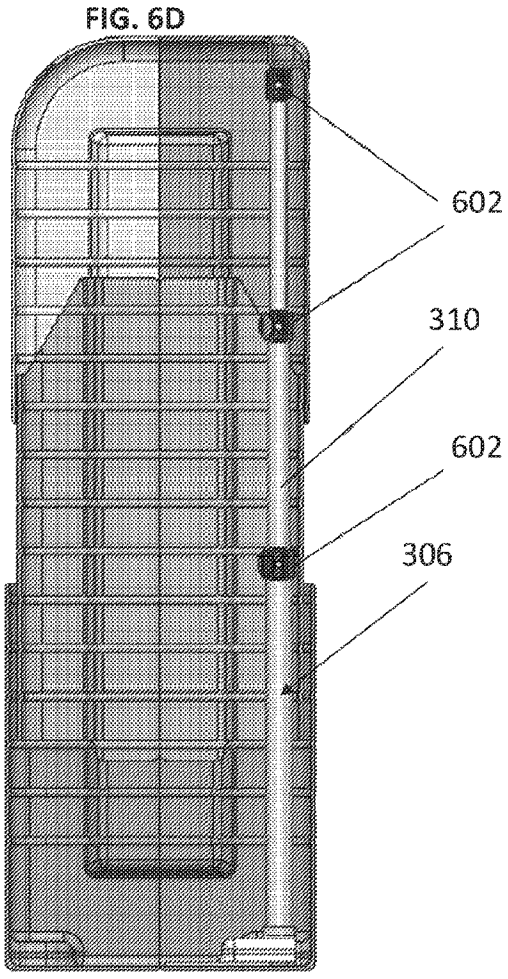
FIGS. 6A-6D show interior views of an expandable and collapsible luggage item in accordance with embodiments hereof.
Figure 6C:
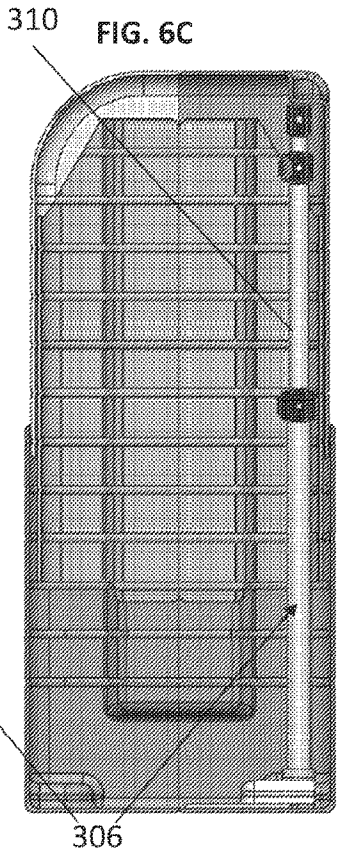

As described herein, the expandable and collapsible luggage item utilizes shell panels that are adjacent and overlap with one another, and as they are collapsed, nest within one another. For example, at a maximum vertical position, i.e., at the largest vertical size for the luggage item (suitably shown in illustrative fashion in FIG. 2A), a portion of a top shell panel 224 of front section 302 overlaps with a portion of a middle shell panel 222 of front section 302. Similarly, a portion of top shell panel 230 of back section 304 overlaps with a portion of middle shell panel 228 of back section 304. Also as shown in FIG. 2A, a portion of bottom shell panel 220 of front section 302 overlaps with a portion of middle shell panel 222 of front section 302, and a portion of bottom shell panel 226 of back section 304 overlaps with a portion of middle shell panel 228 of back section 304. This overlapping construction of the various shell panels is also illustrated in FIG. 3A. FIG. 6A shows a cross section through luggage item 100, illustrating the overlap between the various shell sections, as well as an exemplary positioning for expandable frame 306 within the luggage item 100.

Figure 6B:
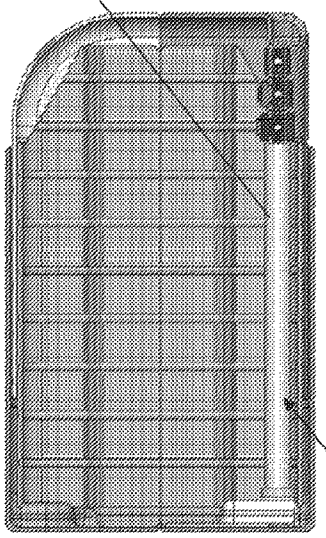
Figure 6A:
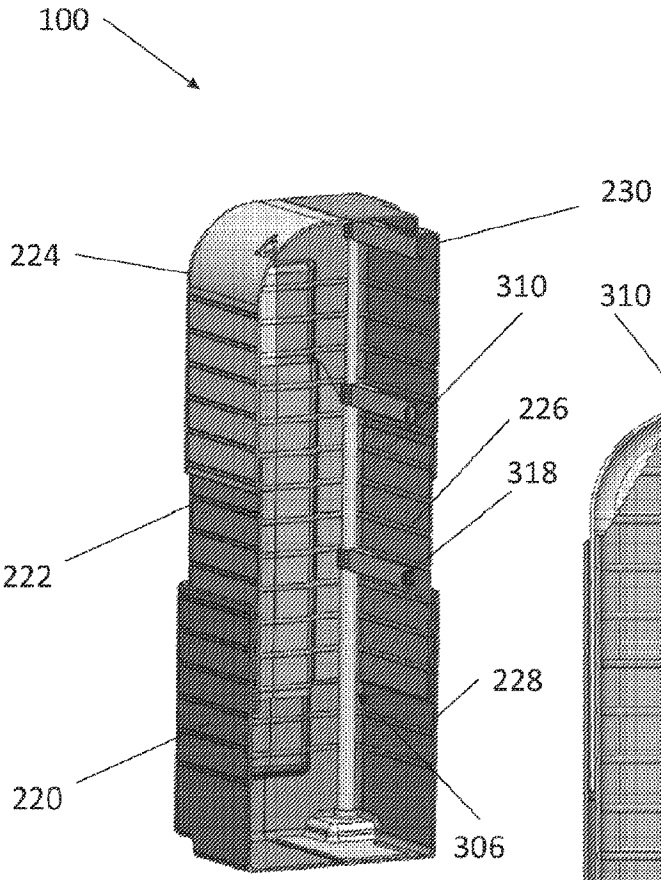
Figures 7A, 7B:
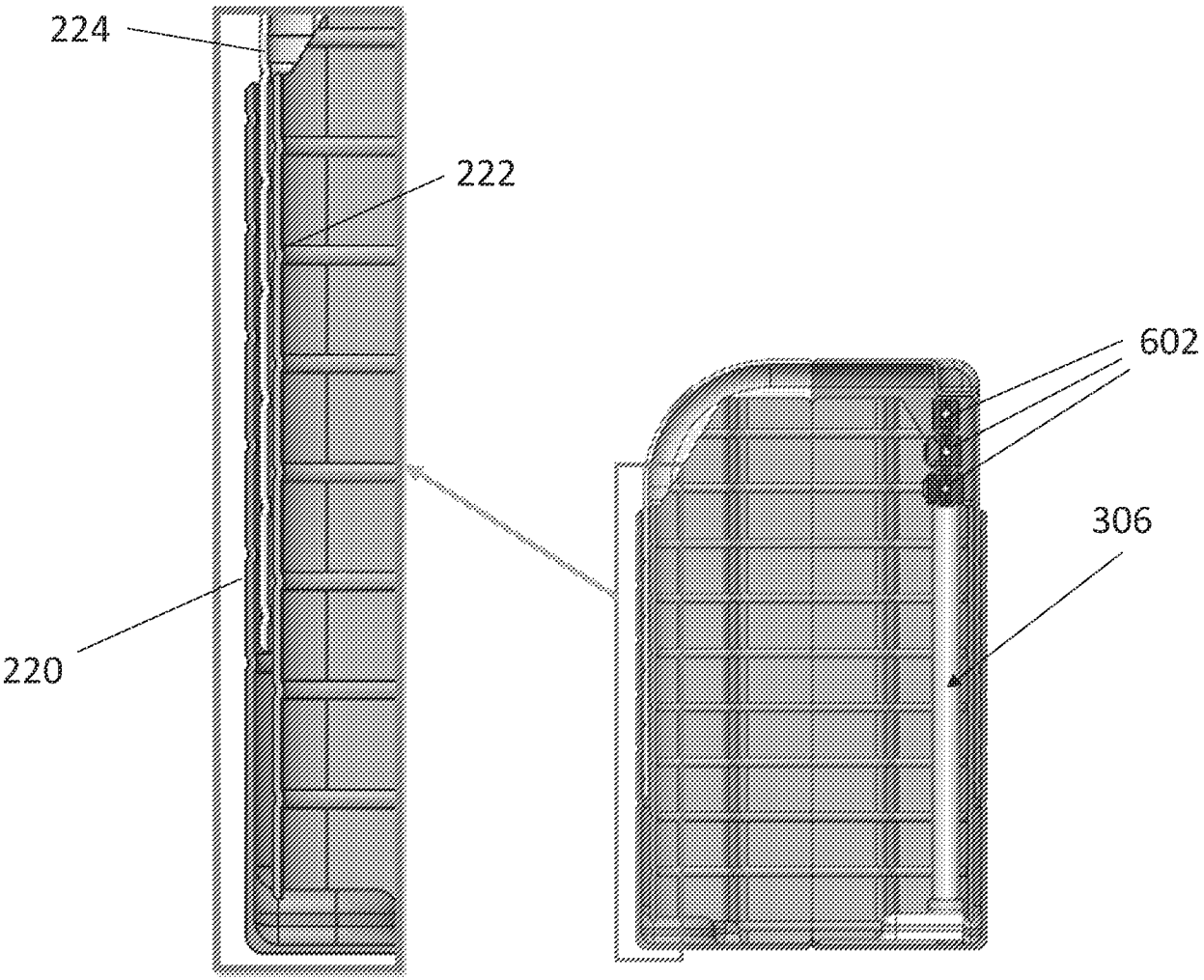
FIG. 7A shows an interior view of an expandable and collapsible luggage item in accordance with embodiments hereof.
FIG. 7B shows a close-up view of a portion of the interior of an expandable and collapsible luggage item in accordance with embodiments hereof.

As illustrated in FIG. 6B, FIG. 7A, and in close-up, FIG. 7B, at a minimal vertical position (i.e., when the luggage item is collapsed to its smallest size), at least portions of all of the three slidably-connected shell panels of the front section overlap and at least portions of all of the three slidably-connected shell panels of the back section overlap. Various different configurations for overlapping the three slidably-connected shell panels can be utilized, and the skilled artisan will understand that such overlap will also vary as the number of shell panels is increased or decreased relative to three, as shown. In exemplary embodiments, as illustrated in FIG. 7A and in close-up in FIG. 7B, at the minimum vertical position, a portion of top shell panel 224 of front section 302 is nested between a portion of bottom shell panel 220 and middle shell panel 222 of front section 302. As used herein "nested between" refers to a configuration in which one or more shell panels are sandwiched between at least two other shell panels, such that one shell panel is flanked on either side by two other shell panels (in FIG. 7B, top shell panel 224 is nested between bottom shell panel 220 on the left and middle shell panel 222 on the right). "A portion" of a shell panel refers to less than the entire shell panel, and as illustrated in FIG. 7B, overlapping portions of shell panels that are nested between one another are less than the entirety of the full shell panel. It should be understood that other configurations are possible, where different shell panels are nested between other shell panels of the body. As illustrated in FIG. 7A, in exemplary configurations, a portion of top shell panel 230 of back section 304 is nested between a portion of bottom shell panel 226 and middle shell panel 228 of back section 304.

FIG. 6B also shows expandable frame 306 in a minimal vertical configuration, with the top two sections of the telescoping members 310 contained within the bottom section, and the movable locking mechanisms 602 all locked.

When luggage 100 item is expanded from a minimal vertical configuration show in FIG. 6B, to an intermediate vertical configuration as shown in FIG. 6C, top shell panels 224 and 230 of the front and back sections can be seen to still overlap with the middle shell panel sections 222 and 228, but the portions of the top shell panels that are now nested between the middle shell panel sections and the bottom shell panel sections are much smaller, as the luggage item has expanded and the shell portions are sliding with the expansion. Also shown is expandable frame 306 in an intermediate vertical configuration, with the top sections of the telescoping members contained within the middle section, the middle sections and the bottom sections of the telescoping members fully extended, and the movable locking mechanisms 602 all locked.

When luggage item 100 is expanded from an intermediate vertical configuration show in FIG. 6C, to a maximum vertical configuration as shown in FIG. 6D, top shell panels 224 and 230 of the front and back sections can be seen to still overlap with the middle shell panel sections 222 and 228, but no longer are top shell panels nested between the middle shell panel sections and the bottom shell panel sections, as the luggage item has expanded to a maximum vertical height, and the shell portions are sliding with the expansion. Also shown is expandable frame 306 in a maximum vertical configuration, with the top sections of the telescoping members 310 fully extended, along with the middle sections and the bottom sections of the telescoping members 310 fully extended, and the movable locking mechanisms 602 all locked.

It should be understood that the luggage item 100 undergoes the same configurations described herein when the item is collapsed from a maximum vertical position, to an intermediate vertical position, and then to a minimum vertical configuration.

Figure 9B:
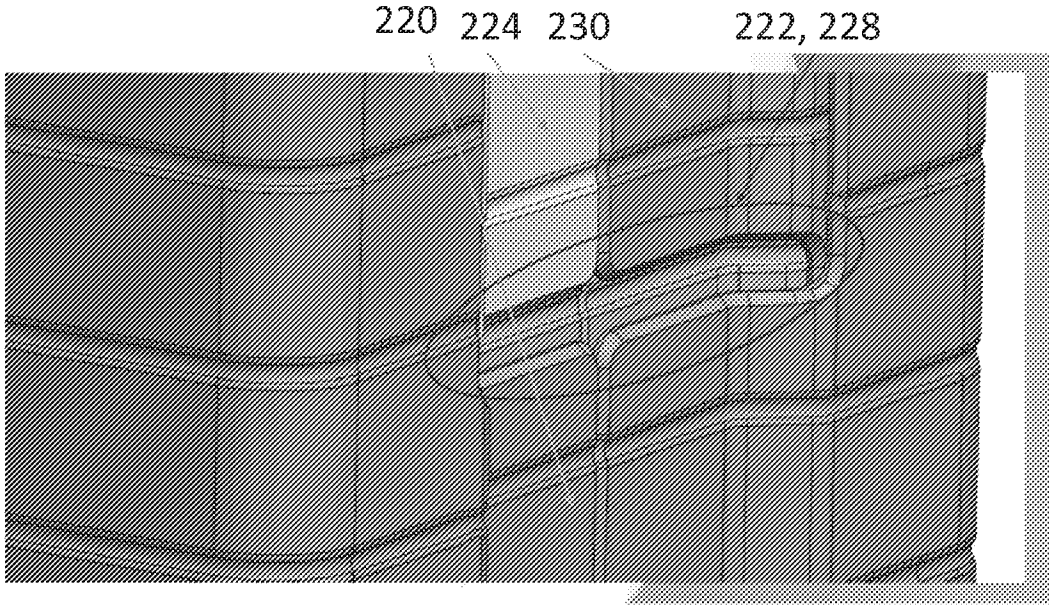
FIG. 9B shows a close-up view of a collapsed expandable and collapsible luggage item in accordance with embodiments hereof.
Figure 9A:
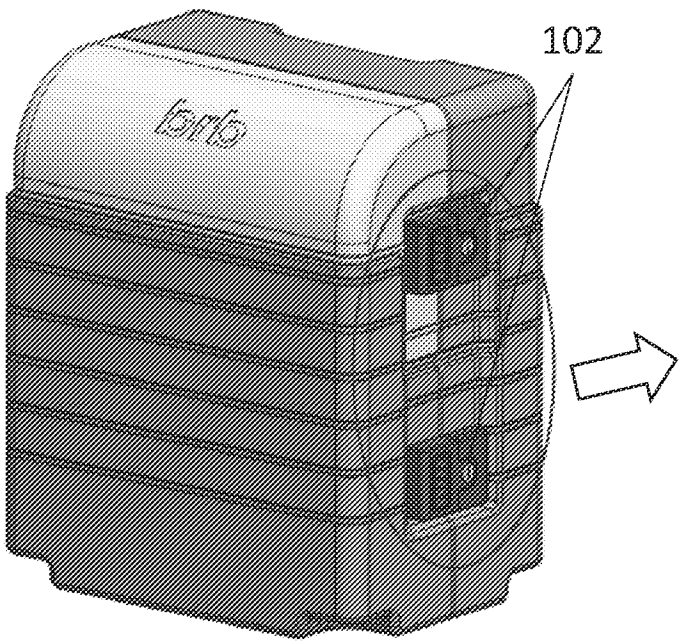
FIG. 9A shows exemplary locations of latching mechanisms for use in an expandable and collapsible luggage item in accordance with embodiments hereof.

In embodiments, the luggage item 100 can further include various locks, latches, zippers, ties, snaps, buckles, etc., that allow for the front 302 and back 304 sections of the body 202 to be secured to one another prior to transport or travel, to prevent items contained within the luggage from spilling out, or from being accessed by unwanted parties. For example, as shown in FIGS. 1B and 1C, the luggage item 100 can include a first latching mechanism 102 configured to secure the top shell panels (224, 230) of the front 302 and back 304 sections and a second latching mechanism 102 configured to secure the bottom shell panels (220, 226) of the front 302 and back sections 304. Latching mechanisms 102 can include various locks, including keyed locks, combination locks, biometric locks, etc. Latching mechanisms 102 are suitably made to be compatible with Federal Aviation Administration standards for access by security personnel. FIG. 9A shows the luggage item 100 in a minimum vertical configuration with two latching mechanisms 102 shown, though a single latching mechanism can also be utilized or more than 2, e.g., 3, 4, 5, 6, etc., latching mechanisms can also be utilized. FIG. 9B shows a closeup of the overlapping nature of the various shell panels of the front and back sections of the body, as described herein.

Figure 10:
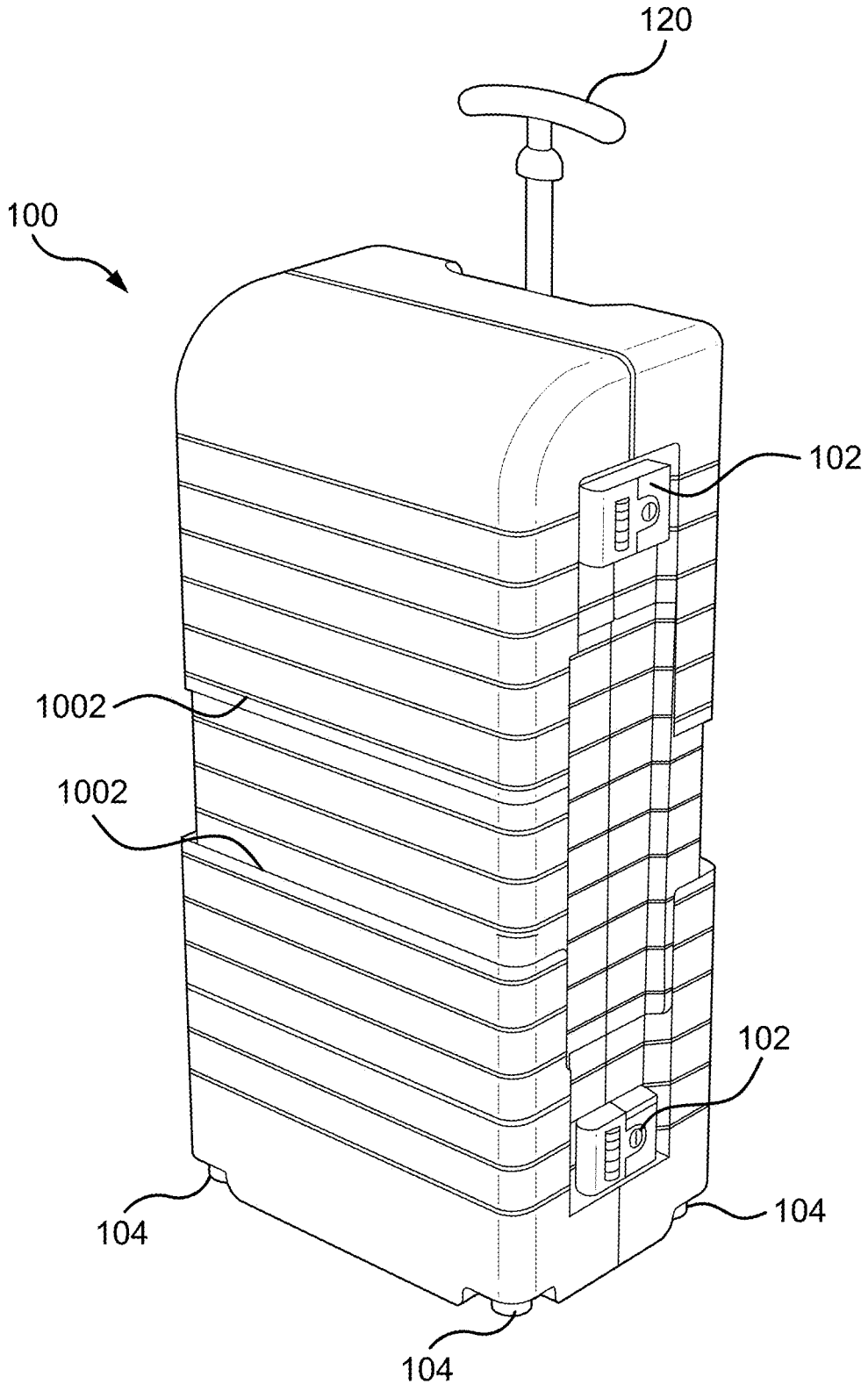
FIG. 10 shows a further expandable and collapsible luggage item in accordance with embodiments hereof.

FIG. 10 shows a further embodiment of a luggage item 100 as described herein, which can also include a handle 120 (see also FIGS. 1A-1C for additional handle configurations). Handle 120 can be a single "pole" type handle, or a double-pole handle, as shown in FIGS. 1A-1C, which can be adjustable/extendable as well as other configurations known in the art (e.g., pull strap, fabric handle, molded handle, etc.). Fixed handles can also be included.

FIG. 10 (as well as FIGS. 1A-1C) also shows the positioning of one or more roller components 104 at the base of the luggage item. Suitably, the luggage item includes two roller components 104 at a base of back section 304, to allow for the luggage item to be tilted and rolled, or can include roller components 104 at all four corners of the luggage item, i.e., at the base of the front section 302 and the base of the back section 304, to allow the luggage item to be rolled in fully upright manner. Exemplary roller components 104 are known in the art and include a ball bearing inside of a suitable holder, a caster, or a wheel or wheel-like component. Roller components can be recessed into the back section and/or front section as desired, or can be retracted into and deployed from a recessed position, when desired, or can be fixed in a non-recessed position on the exterior of the body 202.

Figure 11:
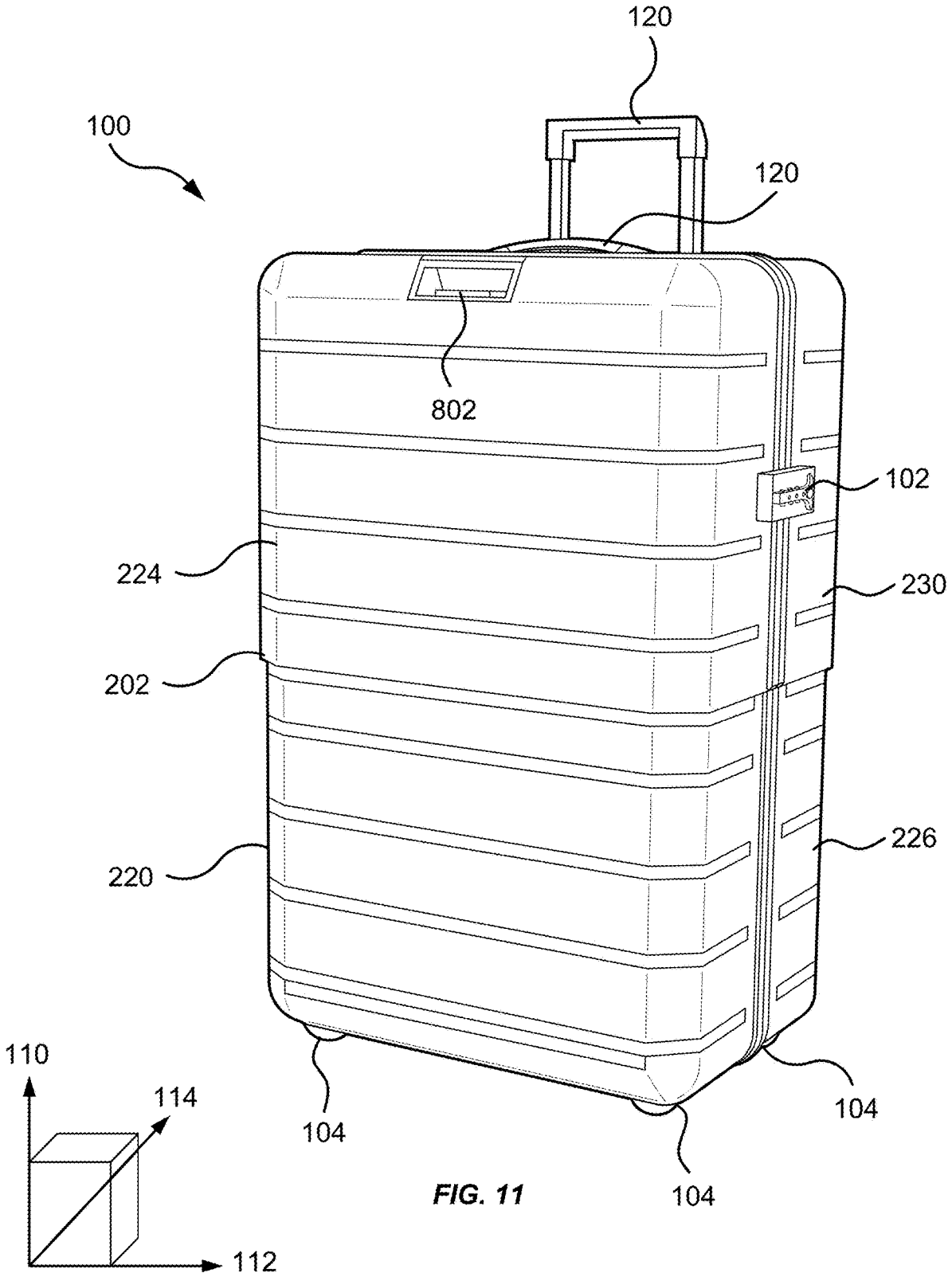
FIG. 11 shows the body of an expandable and collapsible luggage item in accordance with embodiments hereof.

FIG. 11 (as well as FIGS. 12-17B) show additional embodiments of the expandable and collapsible luggage item 100 comprising of a front section 302 and a back section 304, the front section including two slidably-connected shell panels, a top shell panel 224 of front section 302 and a bottom shell panel 220 of front section 302, and back section 304 including two slidably-connected shell panels, a top shell panel 230 of back section 304 and a bottom shell panel 226 of back section 304. The shell panels overlap with one another as the expandable and collapsible luggage item is collapsed and expanded. The expandable and collapsible luggage item in FIGS. 11-17B can suitably expand and collapse into a minimum of two vertical positions, and suitably a minimum of three vertical positions. For example, at a maximum vertical position, i.e., at the largest vertical size for the luggage item (suitably shown in illustrative fashion in FIG. 13C), a portion of top shell panel 224 of front section 302 overlaps with a portion of bottom shell panel 220 of front section 302. Similarly, a portion of top shell panel 230 of back section 304 overlaps with a portion of bottom shell panel 226 of back section 304.

Figure 12:
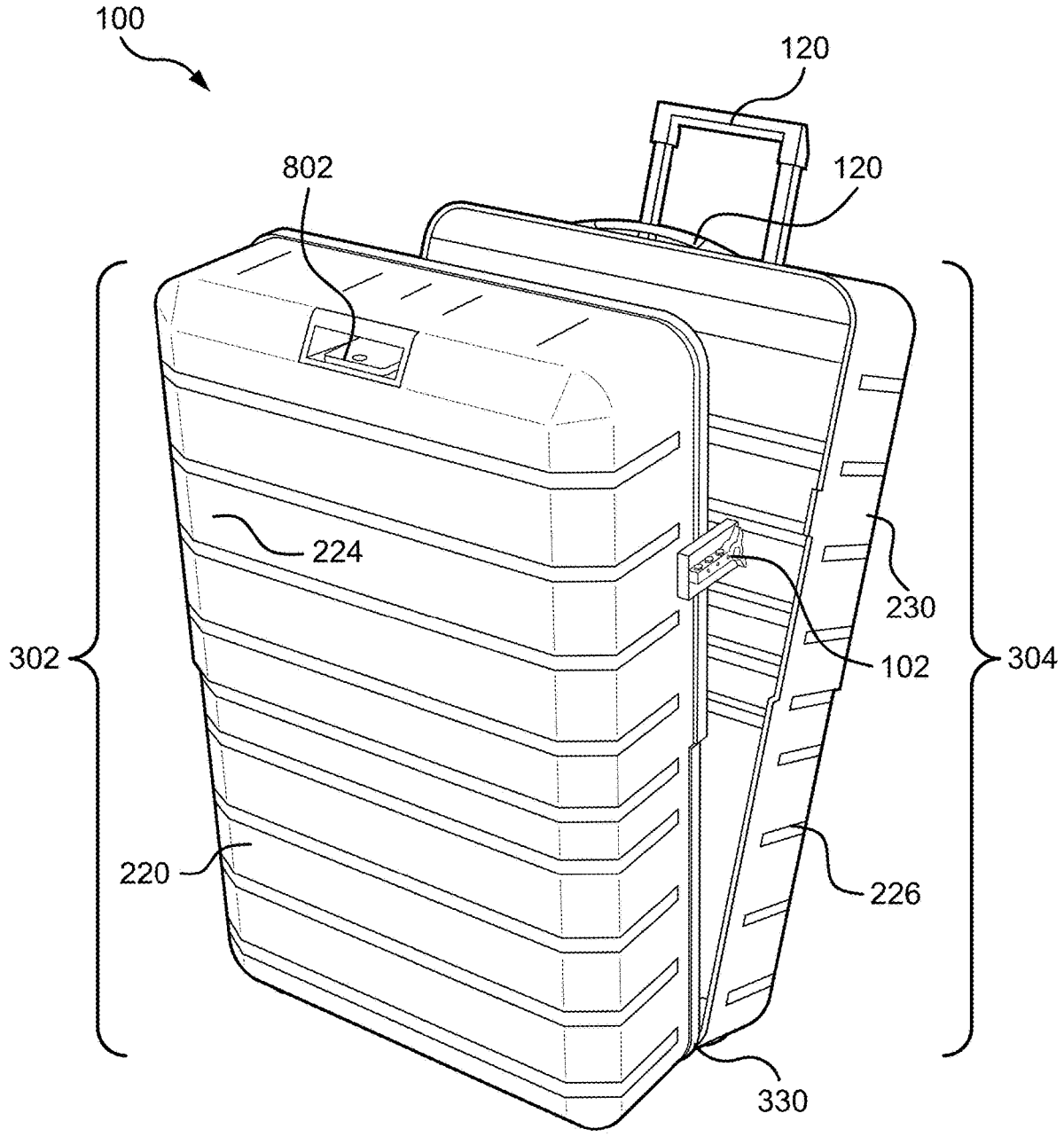
FIG. 12 shows shell panels of an expandable and collapsible luggage item in accordance with embodiments hereof.
Figures 13A, 13B, 13C:
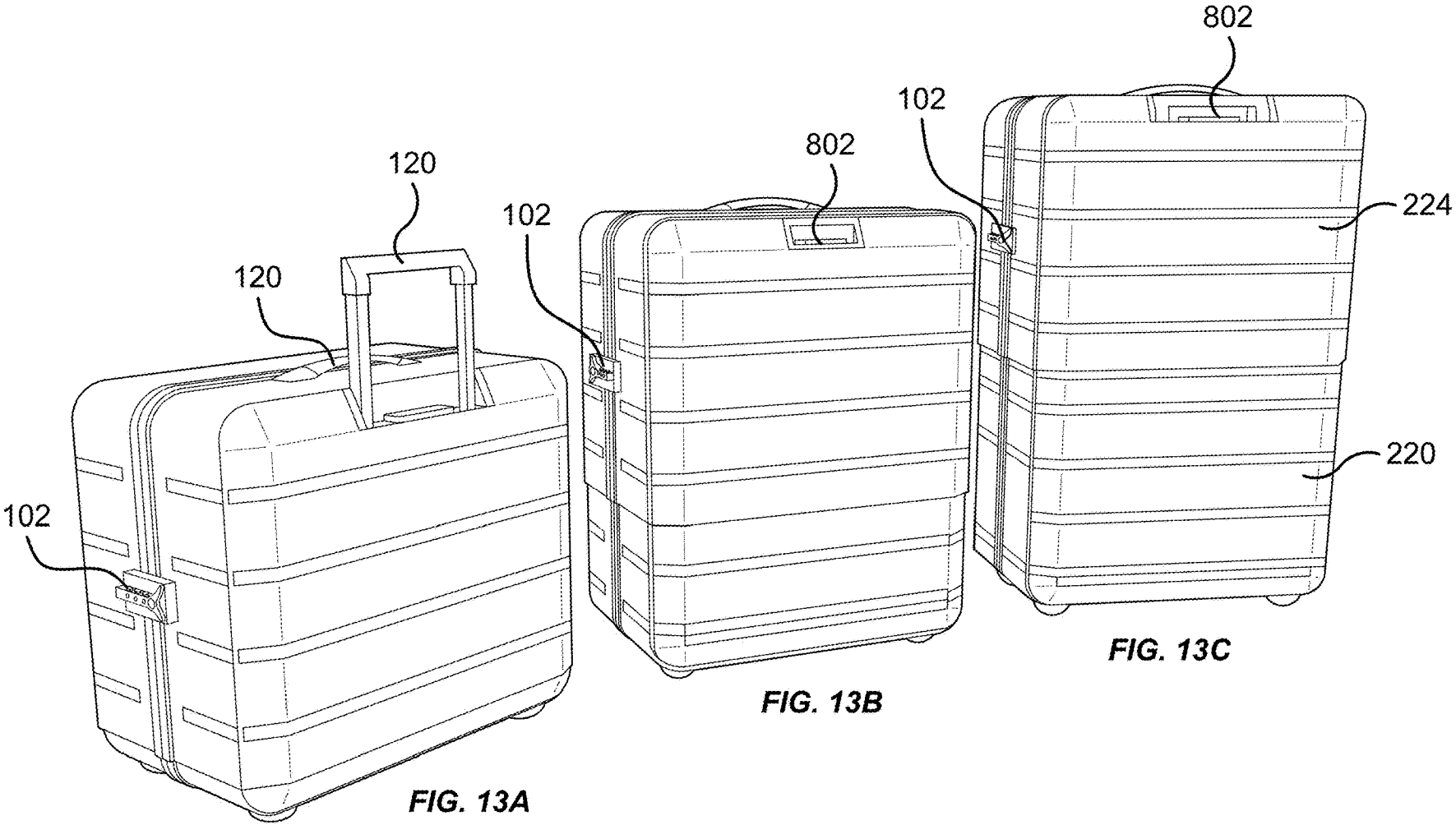
FIGS. 13A-13C show the various vertical positions of an expandable and collapsible luggage item in accordance with embodiments hereof.

As seen in FIG. 12, embodiments of luggage item 100 can include one or more, suitably two or more, suitably two, three or four, hinges 330, which can be located near the top and bottom of body 202, and/or in the middle of body 202 to provide additional strength and support. For example, FIG. 12 shows hinges 330 located on the bottom of the luggage item, between, and joining, bottom shell panel 220 of front section 302 and bottom shell panel 226 of back section 304.

Figure 16C:
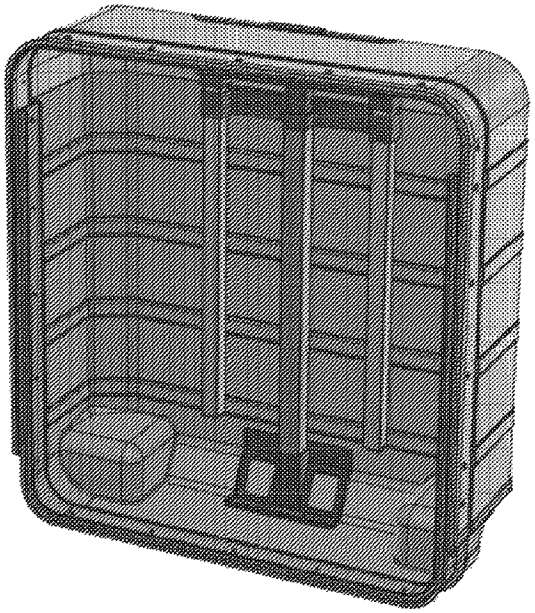
FIGS. 16A-16C show interior views of an expandable and collapsible luggage item in accordance with embodiments hereof.
Figure 16B:
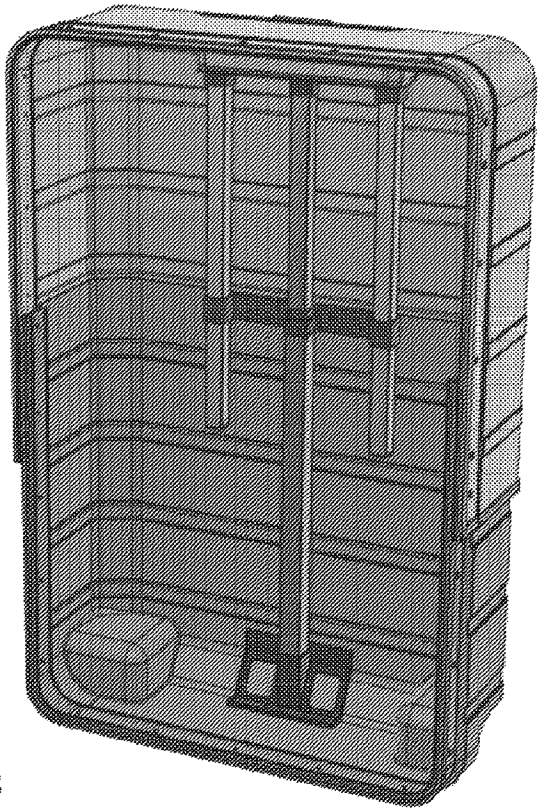
Figure 16A:
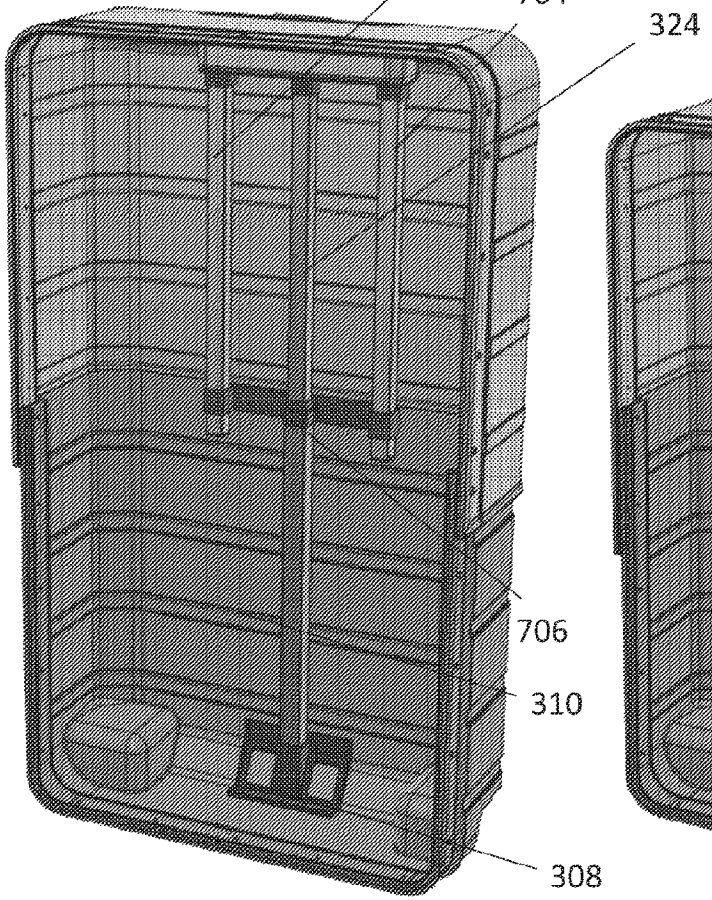

In some embodiments, luggage item 100 expands and collapses via the aid of a telescoping member connected to an interior 312 of back section 304, or suitably connected to an interior 320 of front section 302, or suitably connected to the interior 312 of back section 304 and the interior 320 of front section 302. Telescoping member is configured to expand and collapse luggage item 100 to a minimum of two vertical positions. In some embodiments described herein and shown in FIGS. 16A-16C, expandable frame 306 comprises one telescoping member 310, two vertical support bars 702 and 704, wherein both vertical support bars are connected to the telescoping member 310 via a horizontal bracket 706. As shown in FIGS. 16A-16C, one vertical support bar 702 is disposed to the left of telescoping member 310, and one vertical support bar 704 is disposed to the right of telescoping member 310. Embodiments of luggage item 100 can include one or more, suitably two or more, suitably two, three, or four vertical support bars 702 attached to the telescoping member 310, wherein telescoping members 310 are suitably connected to each other via one or more, suitably at least two (i.e., two or more, including 3 or more, 4 or more, 5 or more, etc.), horizontal supports 706. Horizontal supports 706 are suitably tubes or bars, and can be hollow or solid pieces of metal, plastic, or combinations thereof. As shown in FIG. 16A-16C, each telescoping member 310 includes a moveable locking mechanism that is configured to lock and release the telescoping members 310 at, at least two vertical positions. Moveable locking mechanism can be a locking pin, a locking ball, a locking snap, a locking plunger, or other similar feature, that engages with the telescoping member and stops it from moving (collapsing/expanding) and maintains it in its current position and capable of supporting a load and providing strength to the luggage item. When the moveable locking mechanism is disengaged, the telescoping member(s) can collapse or expand, allowing the luggage item to be moved to a different size.

Figure 14C:
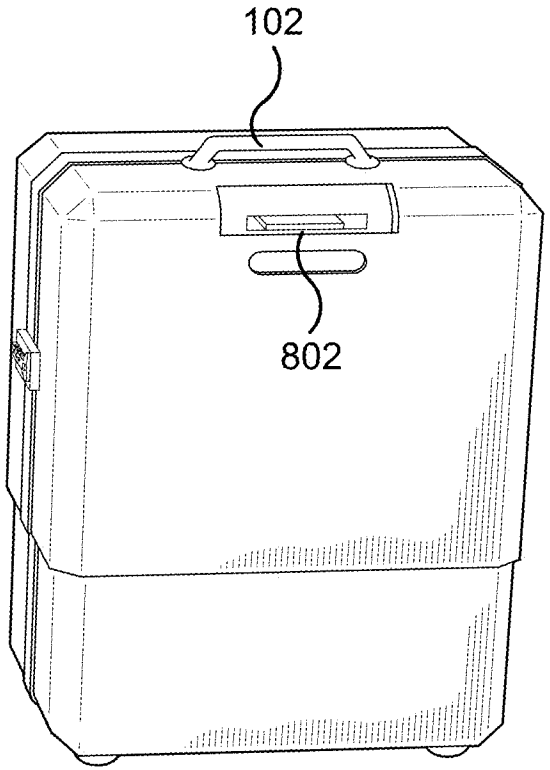
FIGS. 14A-14E show an expandable and collapsible luggage item in accordance with embodiments hereof.
Figure 14B:
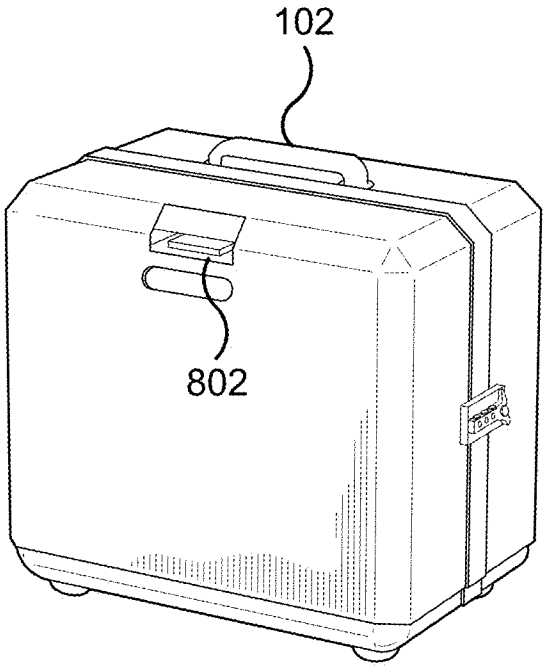
Figure 14A:
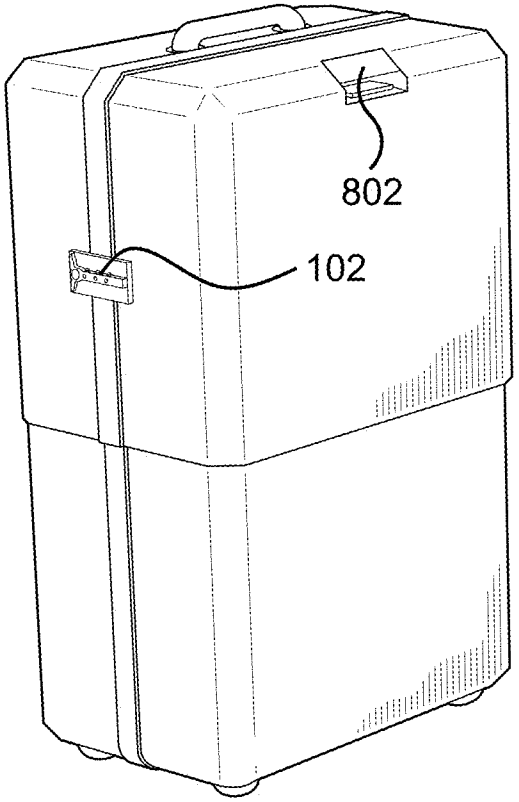
Figure 14D:
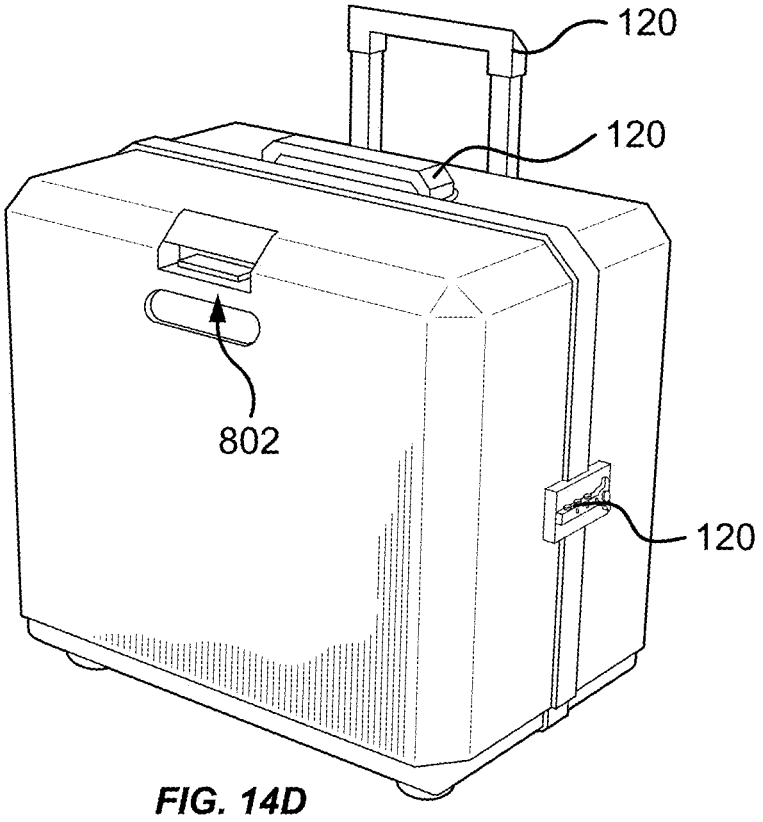
Figure 14E:
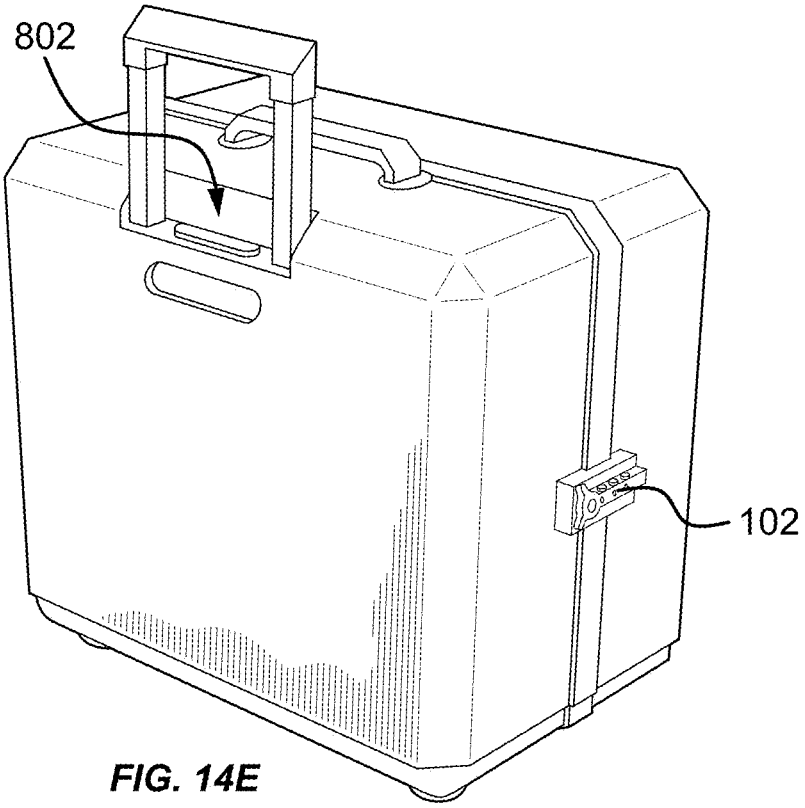
Figure 15B:
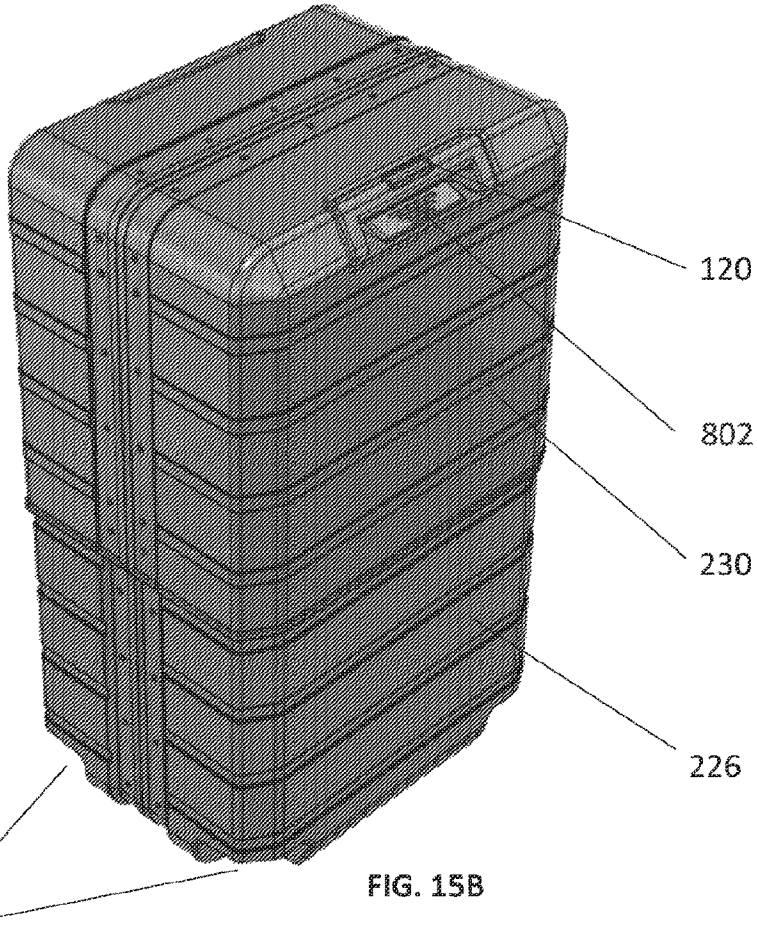
FIGS. 15A-15B show the body of an expandable and collapsible luggage item in accordance with embodiments hereof.
Figure 15A:
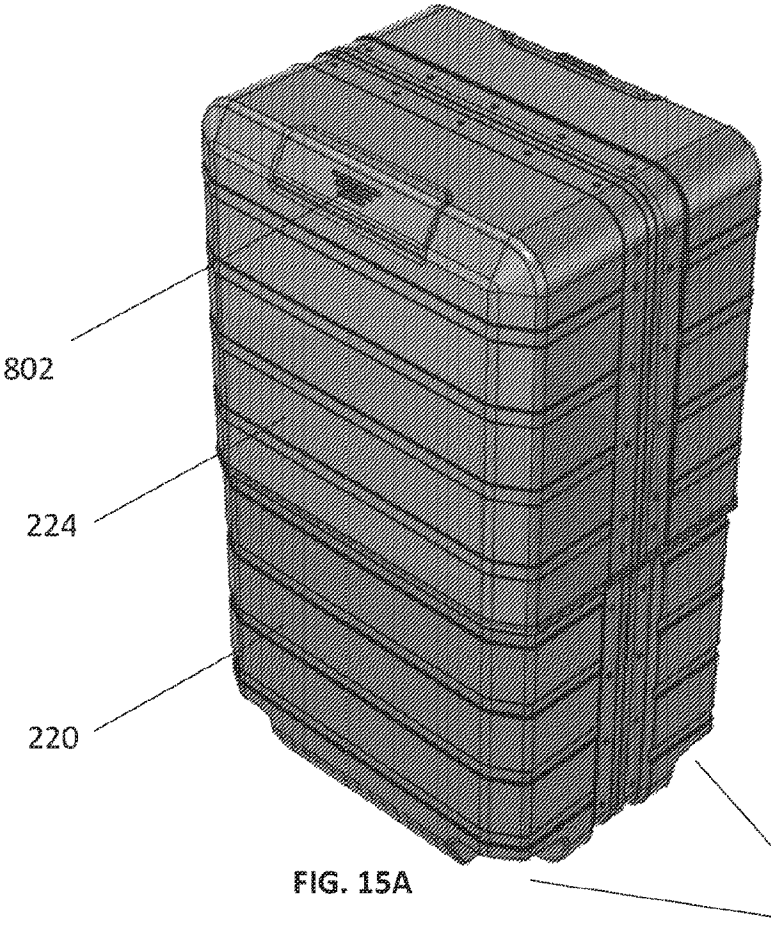

As shown in FIGS. 12-14C, and as a close-up in FIG. 14D-14E, suitably at least one release point 802 for moveable locking mechanism 602 is included, and in embodiments, multiple release points 802 can be utilized. Release point(s) 802 can be located at the end of the horizontal supports near the moveable locking mechanism 602, or in the middle of the horizontal support, or in any desired configuration. In embodiments, a single release point 802 can be utilized, for example as shown in FIGS. 14D and 14E, and as described herein and can also be outside the luggage item 100. FIGS. 15A-15B show an embodiment of luggage item 100 as described herein, which can include at least two release points 802, corresponding to a telescoping member connected to the interior 320 of front section 302 and a telescoping member connected to the interior 312 of back section 304, wherein the two release points 802 are located on the exterior of the body 202 of luggage item 100. In this embodiment, the two release points 802 are suitably engaged simultaneously to allow luggage item 100 to collapse or expand. Release point 802 can be a button, a slide, a latch, a push-pin, a rotating device, or any suitable release mechanism that allows for the moveable locking mechanism 602 to disengage, and allow the telescoping member(s) to move in an expanding or collapsing manner, as desired.

FIGS. 11 and 12 show an embodiment of a luggage item 100 as described herein, which can include a handle 120 or multiple handles 120. Handle 120 can be a single "pole" type handle, or a double-pole handle, as shown in FIGS. 11 and 12, which can be adjustable/extendable as well as other configurations known in the art (i.e., pull strap, fabric handle, molded handle, etc.). Fixed handles can also be included, as can be seen in FIGS. 11 and 12.

In embodiments, luggage item 100 can further include various locks, latches, zippers, ties, snaps, buckles, etc., that allow for the front 302 and back 304 sections of the body 202 to be secured to one another prior to transport or travel, to prevent items contained within the luggage item 100 from spilling out, or from being accessed by unwanted parties. For example, as shown in FIGS. 11-14C, the luggage item 100 can include a single latching mechanism 102 configured to secure the front section 302 of the body 202 to the back section 304 of the body 202. Latching mechanisms 102 can include various locks, including keyed locks, combination locks, biometric locks, etc. Latching mechanisms are suitably made to be compatible with Federal Aviation Administration standards for access by security personnel. FIG. 14A-14C show the luggage item 100 in various vertical configurations with a single latching mechanism 102, though more than one, e.g., 2, 3, 4, 5, etc., latching mechanisms 102 can also be utilized.

The telescoping members 310 of expandable frame 306 can be directly connected to interior 320 of front section 302 and interior 312 of back section 304 (for example, by being molded into or otherwise connected to back section 304), or telescoping members 310 of expandable frame 306 can be connected to or include a support base 308, which in turn is connected directly to interior 320 of front section 302 or interior 312 of back section 304 (suitably to the bottom shell panel 220 or 226). Support base 308 suitably is a flat metal or plastic section that adds strength to the expandable frame 306, and expandable frame 306 itself suitably is composed of metal or plastic or a combination of these materials.

In embodiments, front section 302 of body 202 of luggage item 100 also suitably includes a support bracket 314 on the interior 320 of the front section 302. Support bracket 314 suitably bridges (i.e. connects and/or is connected to), bottom shell panel 220 and top shell panel 224. As described herein, for front section 302 of body 202, bottom shell panel 220 is slidably-connected to top shell panel 224. It should be understood that while support bracket 314 is shown on the interior 320 of front section 302, and expandable frame 306 is shown in the interior 312 of back section 304 of body 202, the location of these interior mechanical elements can be switched to the other (front or back) section of the body 202. Elements and configurations of support bracket 314 are described herein.

FIG. 16C shows expandable frame 306 in a minimal vertical configuration, with two sections of the telescoping member 310 contained within the bottom section, and the moveable locking mechanisms 602 all locked. When luggage item 100 is expanded from a minimal vertical configuration shown in FIG. 16C, to an intermediate vertical configuration shown in FIG. 16B, top shell panels 230 of back section 304 can be seen to still overlap with the bottom shell panel section 226 of back section 304. Also shown is expandable frame 306 in an intermediate vertical configuration, with the top sections of the telescoping members 310 contained within the middle section, the middle and bottom sections of the telescoping members 310 fully extended, and the moveable locking mechanisms 602 all locked.

When luggage item 100 is expanded from an intermediate vertical configuration shown in FIG. 16B, to a maximum vertical configuration as shown in FIG. 16A, top shell panel 230 of back section 304 can be seen to still overlap with the bottom shell panel 226 of back section 304. Also shown is expandable frame 306 in a maximum vertical configuration, with the top sections of the telescoping members 310 fully extended, along with the middle sections and the bottom sections of the telescoping members 310 fully extended, and the moveable locking mechanisms 602 all locked.

FIGS. 16A-16C show three exemplary positions of expandable frame 306 located within the interior 312 of back section 304 of body 202, with the telescoping members 310 at a minimum height (FIG. 16C; about 12-15 inches, suitably about 14 inches), a maximum height (FIG. 16A; about 25-30 inches, suitably about 27 inches), and an intermediate height (FIG. 16B; about 20-24 inches, suitably about 22 inches).

Figure 17A:
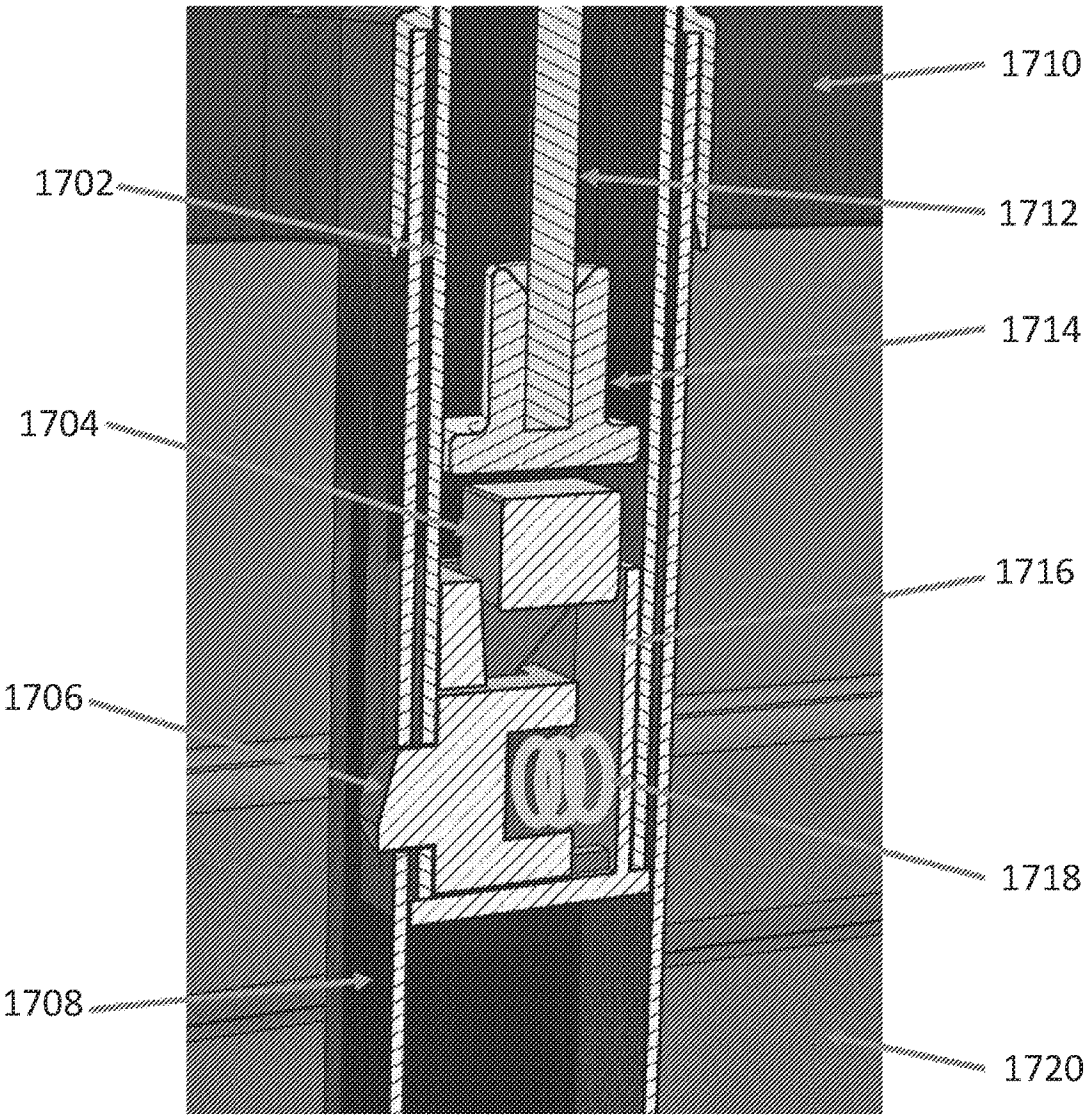
FIG. 17A-17B show a close-up view of a portion of the interior of an expandable and collapsible luggage item in accordance with embodiments hereof.
Figure 17B:
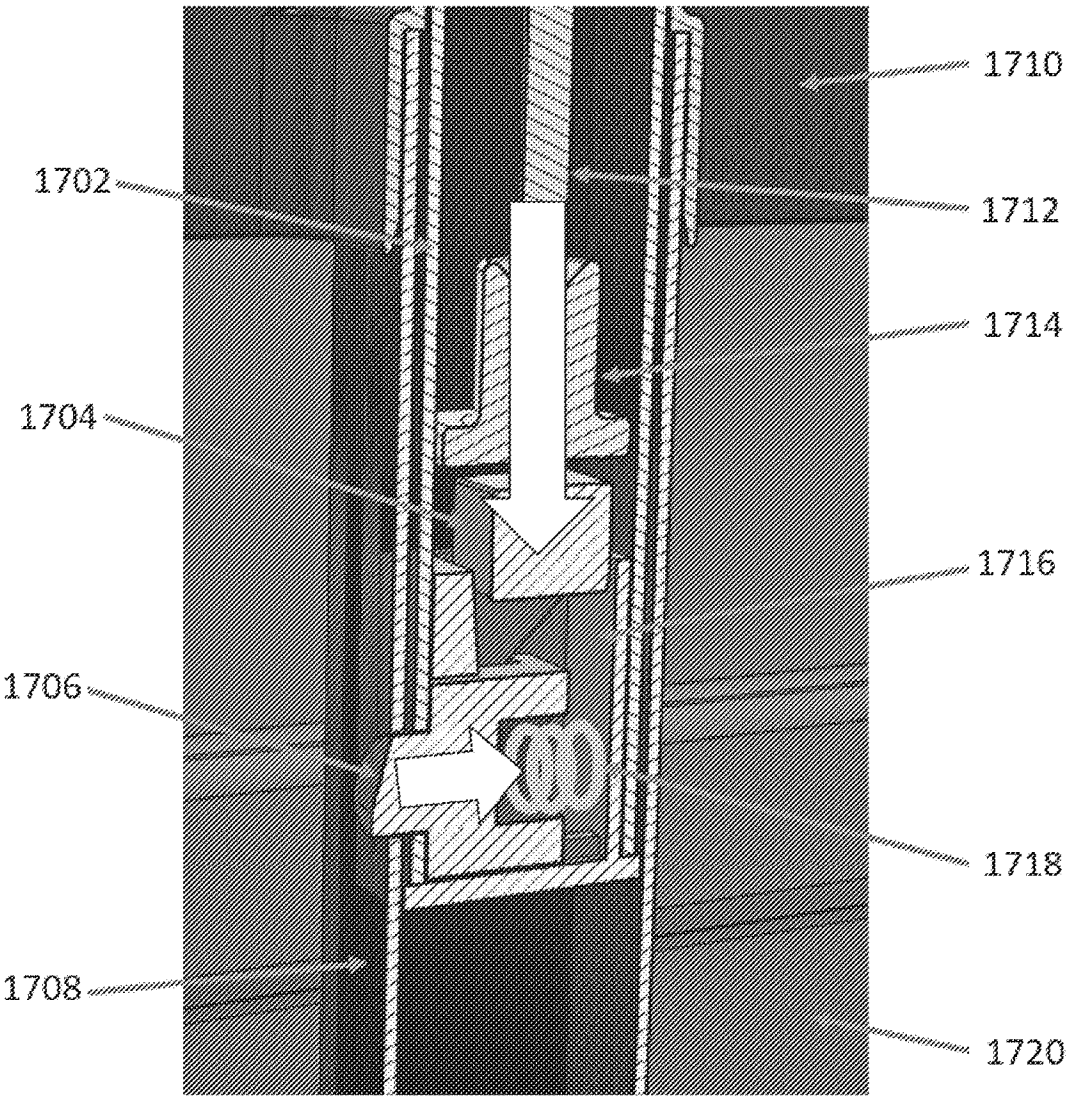

FIGS. 17A-17B show the moveable locking mechanism 602 and release point 802 mechanism attached to the telescoping mechanism mounting bracket 1710 of a telescoping member 310, wherein when the release point 802 on luggage item 100 is engaged, the rod 1712 pushes down on the pusher 1714 and pushes down on the vertical to horizontal translation converter component 1704, wherein the converter component 1704 enters into the inner tube end-cap and locking module housing 1716 and pushes the locking pin 1706 back, engaging spring 1718 to clear the locking holes on the tubes (1702, 1708), and allows luggage item 100 to expand or collapse shell panels 1720 accordingly.

In embodiments, luggage item 100 includes a front section 302 of body 202 having two slidably-connected shell panels (220, 224), a back section 304 of body 202 having two slidably-connected shell panels (226, 230), at least one telescoping member 310 connected to the interior 312 of back section 304; and in embodiments, at least one support bracket 314, the support bracket 314 bridging a bottom shell panel 220 and a top shell panel 224 of front section 302 or bridging a bottom shell panel 226 and a top shell panel 230 of the back section 304, wherein the bottom shell panels are slidably-connected to the top shell panels, and wherein the telescoping member is configured to expand and collapse the luggage item to a minimum of two vertical positions.

In additional embodiments, a sealing component or gasket can also be included at the areas where shell panels overlap to limit dirt and debris from entering, but included in such a way that the nesting arrangement described herein can still be attained. See, e.g., FIG. 10 for positions of panel overlap 1002, where such a component can be used (can be used around the entirety of the luggage item at various shell panel overlap positions). Exemplary materials for such a sealing component include various polymers, rubbers, fabrics, etc.

In further exemplary embodiments, provided herein is an expandable and collapsible suitcase, comprising: a hard-shell body including a back section 302 and a front section 304, the front section including three slidably-connected shell panels and the back section including three slidably-connected shell panels; an interior of the back section including an expandable frame 306, the expandable frame having a support base 308 connected to the interior of the back section 304, and two telescoping members 310 connected to the support base, the telescoping members connected to each other via at least two horizontal supports 318; and an interior of the front section 302 including two support brackets, a first support bracket 314 bridging a bottom shell panel 220 and a middle shell panel 222, and a second support bracket 316 bridging the middle shell panel 222 and a top shell panel 224, the first support bracket 314 and the second support bracket 316 each comprising a channel component 502, a glide component 504 and a spring plunger 506, wherein the bottom shell panel 220 is slidably-connected to the middle shell panel 222 and the middle shell panel 222 is slidably-connected to the top shell panel 224, and wherein the expandable frame 306 is configured to expand and collapse the item of luggage to a minimum of two vertical positions (see, e.g., FIGS. 1A-1C and FIGS. 6B-6D).

Exemplary materials for use in a hard-shell body are described herein, and include various polymers, metals, composites, etc. The hard-shell body can also further include a fabric as part of the body and/or lining the interior of the back section and/or the interior of the front section. For example, a fabric can be used as the material where the front and back section close (e.g., a zippered, fabric portion), or a fabric can be used to line the interior of the body to cover the internal mechanisms (i.e., expandable frame(s) and support bracket(s)), to limit dirt getting into the these areas and to limit users getting items or fingers caught in the mechanisms.

As described herein, suitably the two telescoping members 310 each include a movable locking mechanism 602 that is configured to lock and release at the three vertical positions (see, e.g., FIGS. 6B-6D). In embodiments, at least one of the horizontal supports 318 includes a release point 802 for the movable locking mechanism 602. As shown in FIG. 3F, each horizontal support 318 can include multiple (e.g., 2 or 3, or 4, etc.) release points 802, or each can include a single release point 802, or the entire luggage item can include a single release point 802 (can be internal or external), as shown in FIGS. 8A-8B.

In embodiments, at a maximum vertical position, a portion of a top shell panel 224 of the front section 302 overlaps with a portion of a middle shell panel 222 of the front section 302, a portion of a top shell panel 230 of the back section 304 overlaps with a portion of a middle shell panel 228 of the back section 304, a portion of a bottom shell panel 220 of the front section 302 overlaps with a portion of a middle shell panel 222 of the front section 302, and a portion of a bottom shell panel 226 of the back section 304 overlaps with a portion of a middle shell panel 228 of the back section 304.

As described herein, suitably, at a minimal vertical position, at least portions of all of the three slidably-connected shell panels of the front section overlap and at least portions of all of the three slidably-connected shell panels of the back section overlap. Suitably in some embodiments, at the minimum vertical position, a portion of a top shell panel 224 of the front section 302 is nested between a portion of a bottom shell panel 220 and a middle shell panel 222 of the front section 302, and a portion of the top shell panel 230 of the back section 304 is nested between a portion of a bottom shell panel 226 and a middle shell panel 228 of the back section 304, as shown in FIGS. 6A-6D and FIGS. 7A-7B.

As described herein, luggage item 100 can include a first latching mechanism 102 configured to secure the top shell panels of the front and back sections and a second latching mechanism 102 configured to secure the bottom shell panels of the front and back sections.

As shown in FIGS. 14A-14E, the luggage item 100 can include a latching mechanism 102 configured to secure the front section 302 and the back section 304 of the body 202 located on the top shell panels 224 and 230 of front 302 and back 304 sections of the body 202. Latching mechanisms 102 can include various locks, including keyed locks, combination locks, biometric locks, etc. FIGS. 14A-14E show the luggage item in various vertical configurations with a single latching mechanism 102 located on the top shell panels 224 and 230 of front 302 and back 304 sections of the body 202, though more than one, e.g., 2, 3, 4, 5, 6, etc. latching mechanisms 102 can also be utilized. Also as shown in FIGS. 14A-14E and in close-up in FIGS. 14D-14E, suitably at least one release point 802 can be located outside the luggage item 100. FIG. 14D shows release point 802 on the top shell panel 224 of the front section 302 in a minimum vertical configuration. FIG. 14E shows release point 802 on the top shell panel 230 of the back section 304, below a double-pole expandable/collapsible handle 120 in a minimum vertical configuration. FIGS. 14D-14E show embodiments of a luggage item 100 having both a fixed handle 120 and a double-pole expandable/collapsible handle 120.

In embodiments, the luggage item 100 can further include two roller components 104 at a base of the back section, as well as optionally two roller components 104 at a base of the front section, and such roller components can be recessed into the front and/or back sections as desired and as described herein.

While various embodiments have been described above, it should be understood that they have been presented only as illustrations and examples of the present invention, and not by way of limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the appended claims and their equivalents. It will also be understood that each feature of each embodiment discussed herein, and of each reference cited herein, can be used in combination with the features of any other embodiment.

All publications, patents and patent applications mentioned in this specification are herein incorporated by reference to the same extent as if each individual publication, patent or patent application was specifically and individually indicated to be incorporated by reference.

What is claimed is:

1. An expandable and collapsible luggage item, comprising:

a) a body including a back section and a front section, the front section including three slidably-connected shell panels and the back section including three slidably-connected shell panels;

b) an interior of the back section including an expandable frame comprising two telescoping members connected to the interior of the back section; and c) an interior of the front section including two support brackets, a first support bracket bridging a bottom shell panel and a middle shell panel, and a second support bracket bridging the middle shell panel and a top shell panel, wherein the bottom shell panel is slidably-connected to the middle shell panel and the middle shell panel is slidably-connected to the top shell panel, wherein the expandable frame is configured to expand and collapse the luggage item to a minimum of two vertical positions.

2. The expandable and collapsible luggage item of claim 1, wherein the body is a hard-shell body.

3. The expandable and collapsible luggage item of claim 1, wherein the two telescoping members are connected to each other via at least two horizontal supports, wherein the two telescoping members each include a movable locking mechanism that is configured to lock and release at the two vertical positions.

4. The expandable and collapsible luggage item of claim 3, wherein at least one of the horizontal supports includes a release point for the movable locking mechanisms.

5. The expandable and collapsible luggage item of claim 1, wherein at a maximum vertical position, a portion of a top shell panel of the front section overlaps with a portion of a middle shell panel of the front section, a portion of a top shell panel of the back section overlaps with a portion of a middle shell panel of the back section, a portion of a bottom shell panel of the front section overlaps with a portion of a middle shell panel of the front section, and a portion of a bottom shell panel of the back section overlaps with a portion of a middle shell panel of the back section.

6. The expandable and collapsible luggage item of claim 1, wherein at a minimal vertical position, at least portions of all of the three slidably-connected shell panels of the front section overlap and at least portions of all of the three slidably-connected shell panels of the back section overlap.

7. The expandable and collapsible luggage item of claim 6, wherein at the minimum vertical position a portion of a top shell panel of the front section is nested between a portion of a bottom shell panel and a middle shell panel of the front section, and wherein a portion of the top shell panel of the back section is nested between a portion of a bottom shell panel and a middle shell panel of the back section.

8. The expandable and collapsible luggage item of claim 1, further including a first latching mechanism configured to secure the top shell panels of the front and back sections and a second latching mechanism configured to secure the bottom shell panels of the front and back sections.

9. The expandable and collapsible luggage item of claim 1, wherein the first support bracket and the second support bracket each comprise a channel component, a glide component and a spring plunger.

10. The expandable and collapsible luggage item of claim 1, further comprising two roller components at a base of the back section and optionally two roller components at a base of the front section, wherein the roller components are recessed into the back section and/or the front section.

11. An expandable and collapsible suitcase, comprising:

a) a hard-shell body including a back section and a front section, the front section including three slidably-connected shell panels and the back section including three slidably-connected shell panels;

b) an interior of the back section including an expandable frame, the expandable frame having a support base connected to the interior of the back section, and two telescoping members connected to the support base, the telescoping members connected to each other via at least two horizontal supports; and c) an interior of the front section including two support brackets, a first support bracket bridging a bottom shell panel and a middle shell panel, and a second support bracket bridging the middle and a top shell panel, the first support bracket and the second support bracket each comprising a channel component, a glide component and a spring plunger, wherein the bottom shell panel is slidably-connected to the middle shell panel and the middle shell panel is slidable-connected to the top shell panel, wherein the expandable frame is configured to expand and collapse the item of luggage to a minimum of two vertical positions.

12. The expandable and collapsible suitcase of claim 11, wherein the two telescoping members each include a movable locking mechanism that is configured to lock and release at the three vertical positions, and wherein at least one of the horizontal supports includes a release point for the movable locking mechanism.

13. The expandable and collapsible luggage item of claim 11, wherein at a maximum vertical position, a portion of a top shell panel of the front section overlaps with a portion of a middle shell panel of the front section, a portion of a top shell panel of the back section overlaps with a portion of a middle shell panel of the back section, a portion of a bottom shell panel of the front section overlaps with a portion of a middle shell panel of the front section, and a portion of a bottom shell panel of the back section overlaps with a portion of a middle shell panel of the back section.

14. The expandable and collapsible luggage item of claim 11, wherein at a minimal vertical position, at least portions of all of the three slidably-connected shell panels of the front section overlap and at least portions of all of the three slidably-connected shell panels of the back section overlap.

15. The expandable and collapsible luggage item of claim 14, wherein at the minimum vertical position a portion of a top shell panel of the front section is nested between a portion of a bottom shell panel and a middle shell panel of the front section, and wherein a portion of the top shell panel of the back section is nested between a portion of a bottom shell panel and a middle shell panel of the back section.

16. The expandable and collapsible suitcase of claim 11, further including a first latching mechanism configured to secure the top shell panels of the front and back sections and a second latching mechanism configured to secure the bottom shell panels of the front and back sections.

17. The expandable and collapsible luggage item of claim 11, wherein the hard-shell body comprises acrylonitrile butadiene styrene, polycarbonate, aluminum, polypropylene, poly (vinyl chloride), or any combination thereof.

18. The expandable and collapsible luggage item of claim 17, wherein the hard-shell body further comprising a fabric as part of the body and/or lining the interior of the back section and/or the interior of the front section.

19. The expandable and collapsible luggage item of claim 11, further comprising two roller components at a base of the back section and two roller components at a base of the front section, wherein the roller components are recessed into the back section and/or the front section.

20. An expandable and collapsible luggage item, comprising:

a. a body including a back section and a front section, the front section including two slidably-connected shell panels and the back section including two slidably-connected shell panels;

b. two telescoping members, a first telescoping member connected to the interior of the front section and a second telescoping member connected to the interior of the back section; and c. at least one support bracket, the support bracket bridging a bottom shell panel and a top shell panel of the front section or bridging a bottom shell panel and a top shell panel of the back section, wherein the bottom shell panels are slidably-connected to the top shell panels, and wherein the telescoping members are configured to expand and collapse the luggage item to a minimum of three vertical positions.

* * * * *